US008350881B2

(12) United States Patent
Ochiai et al.

(10) Patent No.: US 8,350,881 B2
(45) Date of Patent: Jan. 8, 2013

(54) PRINTER

(75) Inventors: Teruyuki Ochiai, Shizuoka-ken (JP); Hiroyasu Ishii, Shizuoka-ken (JP); Osamu Watanabe, Shizuoka-ken (JP); Yukihiro Tamura, Kanagawa-ken (JP); Yoshimi Urushibata, Shizuoka-ken (JP); Kazuhiro Fushimi, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/280,242

(22) Filed: Oct. 24, 2011

(65) Prior Publication Data

US 2012/0038736 A1 Feb. 16, 2012

Related U.S. Application Data

(63) Continuation of application No. 12/890,555, filed on Sep. 24, 2010, now Pat. No. 8,068,127, which is a continuation of application No. 11/475,645, filed on Jun. 27, 2006, now Pat. No. 7,872,662.

(30) Foreign Application Priority Data

Jun. 30, 2005 (JP) ..... 2005-192102
Jul. 11, 2005 (JP) ..... 2005-201294
Aug. 8, 2005 (JP) ..... 2005-229388

(51) Int. Cl.
*B41J 11/00* (2006.01)
*B41J 2/315* (2006.01)
*B41J 2/325* (2006.01)

(52) U.S. Cl. ..... 347/219; 347/220; 347/221; 347/222

(58) Field of Classification Search ..... 347/219–222
See application file for complete search history.

(56) References Cited

U.S. PATENT DOCUMENTS 6,501,498 B2 12/2002 Takahashi et al.
7,852,360 B2 12/2010 Takahashi
7,872,662 B2 1/2011 Ochiai et al.
2001/0005216 A1 6/2001 Takahashi et al.
2001/0026725 A1 10/2001 Petteruti et al.
2003/0103133 A1* 6/2003 Ueda et al. ..... 347/219

(Continued)

FOREIGN PATENT DOCUMENTS

JP 08-258827 10/1996

(Continued)

OTHER PUBLICATIONS

Extended European Search Report dated Mar. 19, 2008, issued in a counterpart European Application.

(Continued)

*Primary Examiner* — Stephen Meier
*Assistant Examiner* — Sarah Al Hashimi
(74) *Attorney, Agent, or Firm* — Patterson & Sheridan, LLP

(57) ABSTRACT

A printer includes an upper unit which opens and closes about a fulcrum lying at a rear position of a lower unit, and a paper path which is opened by opening the upper unit. A sensor unit is attached to the lower unit and includes a lower sensor holder and an upper sensor holder which are disposed in opposition to each other via the paper path. The paper path can be opened by pivoting the upper sensor holder relative to the lower sensor holder. When the upper unit is closed, the upper sensor holder is also closed in accordance with a closing pivoting motion of the upper unit.

23 Claims, 20 Drawing Sheets

U.S. PATENT DOCUMENTS

| | | | | |
|---|---|---|---|---|
| 2007/0081065 | A1 | 4/2007 | Ootsuka et al. | |
| 2009/0255971 | A1 * | 10/2009 | Nakamaki et al. | 226/1 |

FOREIGN PATENT DOCUMENTS

| | | |
|---|---|---|
| JP | 11-199097 | 7/1999 |
| JP | 11-199098 | 7/1999 |
| JP | 2000-016651 | 1/2000 |
| JP | 2000-071533 | 3/2000 |
| JP | 2000-229405 | 8/2000 |
| JP | 2001-277468 | 10/2001 |
| JP | 2003-146493 | 5/2003 |

OTHER PUBLICATIONS

Chinese Office Action dated Apr. 24, 2009 (3 pages), and partial English translation thereof (1 page), issued in counterpart Chinese Application Serial No. 200610106196.8.

Japanese Office Action dated Jul. 28, 2009 and English Translation thereof issued in a counterparts Japanese Application No. 2005-229388.

Japanese Office Action dated May 11, 2010 and English translation thereof issued in counterpart Japanese Application No. 2005-201294.

Japanese Office Action dated Jun. 1, 2010, Japanese Patent Application No. 2005-192102.

* cited by examiner

PRINTER

CROSS-REFERENCE TO RELATED APPLICATION

The present application is a continuation of U.S. patent application Ser. No. 12/890,555, filed Sep. 24, 2011, which is a continuation of U.S. patent application Ser. No. 11/475,645, filed Jun. 27, 2006, now U.S. Pat. No. 7,872,662, issued on Jan. 18, 2011, which claims priority to Japanese Patent Applications P2005-201294 filed on Jul. 11, 2005, P2005-192102 filed on Jun. 30, 2005, and P2005-229388 filed on Aug. 8, 2005.

BACKGROUND OF THE INVENTION

1. Field of the Invention

The present invention relates to a printer such as a thermal printer for printing a bar code or the like onto label paper.

2. Discussion of the Background

There is known a conventional printer wherein a printer body is divided into a lower unit and an upper unit, and a paper path for the conveyance of paper is formed between the lower unit and the upper unit. In the printer of such a structure, for example, the upper unit moves pivotably relative to the lower unit, centered on a pivot member disposed behind the printer body. Therefore, by attaching a print head and so on to the upper unit and a platen to the lower unit, the paper path can be opened when the upper unit is opened. In the case where a paper holder is provided in the lower unit, a roll of paper can be set easily to the paper holder by opening the paper path.

In the case of a label printer, it is necessary to provide a sensor for detecting a printing start position of label paper. If the sensor is a transmission type sensor, in which a light emitting portion and a light receiving portion are made face to face with each other via the paper path, it is necessary to pass paper between the light emitting portion and the light receiving portion. Therefore, if the label printer has the foregoing vertically divided structure able to open the paper path by opening the upper unit, it is necessary to insert paper into the gap between the light emitting portion and the light receiving portion at the time of setting paper. This paper inserting work is troublesome.

Heretofore, for facilitating the paper setting work, there has been proposed a printer wherein a transmission type sensor is made up of two sensor units capable of being opened and closed. One of a light emitting element and a light receiving element is attached to one sensor unit, while the other is attached to the other sensor unit. Therefore, at the time of setting paper, the paper path is opened by opening one sensor unit with respect to the other sensor unit. The printer having a transmission type sensor of such a structure is described for example in Japanese laid-open Patent Publication No. Hei 11 (1999)-199097.

However, in the case of a printer having the aforesaid structure of opening and closing two sensor units, it is necessary that the paper path be opened by pivoting the upper unit and one sensor unit, then after the setting of paper, the paper path be closed by pivoting the upper unit and one sensor unit, and the printer be restored to its usable state. At this time, there is a possibility that the upper unit may be closed while allowing the sensor unit to remain open, causing damage to the sensor unit.

Accordingly, an object of the present invention is to prevent damage of a sensor unit caused by forgetting to close the sensor unit at the time of closing an open upper unit, while adopting a structure able to open a paper path by pivoting one sensor unit.

SUMMARY OF THE INVENTION

A printer according to an embodiment of the invention includes a first unit having a paper holder, a second unit adapted to open and close pivotably relative to the first unit, a paper path which extends from the paper holder to an exterior, a printing section configured to execute a print operation on paper conveyed from the paper holder along the paper path, a sensor unit which: (i) has a lower sensor holder which includes one of a light emitting element and a light receiving element, and an upper sensor holder which includes other one of the light emitting element and the light receiving element, and (ii) is attached to the first unit so that the paper path passes between the lower sensor holder and the upper sensor holder, and a damper mechanism attached to the sensor unit and disposed between the sensor unit and the paper holder, the damper mechanism having a paper abutment portion and a spring, the spring pressing the paper abutment portion against the paper conveyed along the paper path and applying tension to the paper.

A printer according to another embodiment of the invention includes a first unit having a paper roll, a second unit adapted to open and close pivotably relative to the first unit, a paper path which is formed between the first unit and the second unit and extends from the paper roll to an exterior, a printing section configured to execute a print operation on paper, which is conveyed from the paper roll along the paper path, at a first portion of the paper path, a sensor unit which: (i) has a lower sensor holder which includes one of a light emitting element and a light receiving element, and an upper sensor holder which includes other one of the light emitting element and the light receiving element, and (ii) is attached to the first unit so that the paper path passes between the lower sensor holder and the upper sensor holder, and a damper mechanism attached to the sensor unit, the damper mechanism having a paper abutment portion and a spring, the spring pressing the paper abutment portion against the paper at a second portion of the paper path between the sensor unit and the paper roll.

A printer according to still another embodiment of the invention includes a first unit having a paper holder, a second unit adapted to open and close pivotably relative to the first unit, a paper path which is formed between the first unit and the second unit and extends from the paper holder to an exterior, a printing section configured to execute a print operation on paper conveyed from the paper holder along the paper path, a sensor unit which: (i) has a lower sensor holder which includes one of a light emitting element and a light receiving element, and an upper sensor holder which includes other one of the light emitting element and the light receiving element, and (ii) is attached to the first unit so that the paper path passes between the lower sensor holder and the upper sensor holder, and a damper mechanism attached to the sensor unit and disposed between the sensor unit and the paper holder, the damper mechanism having a paper abutment portion and a spring, the spring pressing the paper abutment portion toward the paper conveyed along the paper path.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

An embodiment of the present invention will be described in detail hereinafter with reference to the accompanying drawings. This embodiment is an example of application of the present invention to a thermal printer for printing a bar code or the like to label paper.

Figure 1:
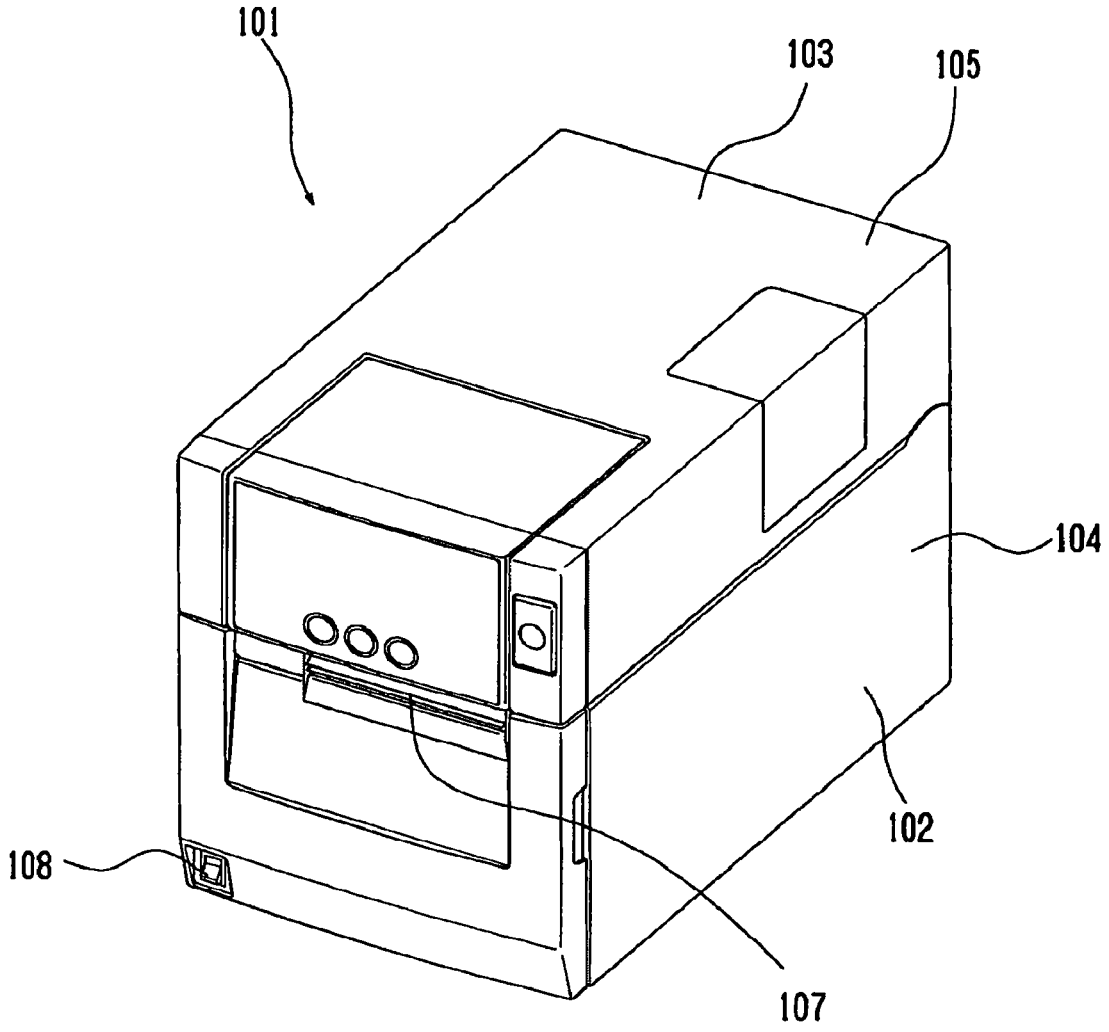
FIG. 1 is a perspective view showing an appearance of the whole of a printer according to an embodiment of the present invention.

FIG. 1 is a perspective view showing an appearance of the whole of a printer 101 according to this embodiment. The printer 101, which is in the shape of a rectangular parallelepiped, is made up a lower unit 102 located at a lower position and an upper unit 103 located at an upper position and is vertically divided into two. The lower unit 102 comprises a lower housing 104 and components housed therein. The upper unit 103 comprises an upper housing 105 and components housed therein.

The printer 101 includes an issuing port 107 for issuing label paper 113 as printing paper to be described later and a power switch 108 at a front side thereof. The issuing port 107 is formed in the shape of a slit between the lower unit 102 and the upper unit 103. The upper unit 103 can be opened and closed relative to the lower unit 102 pivotably about pivot members provided at rear positions. Therefore, upon opening of the upper unit 103, the issuing port 107 is also opened.

Figure 2:
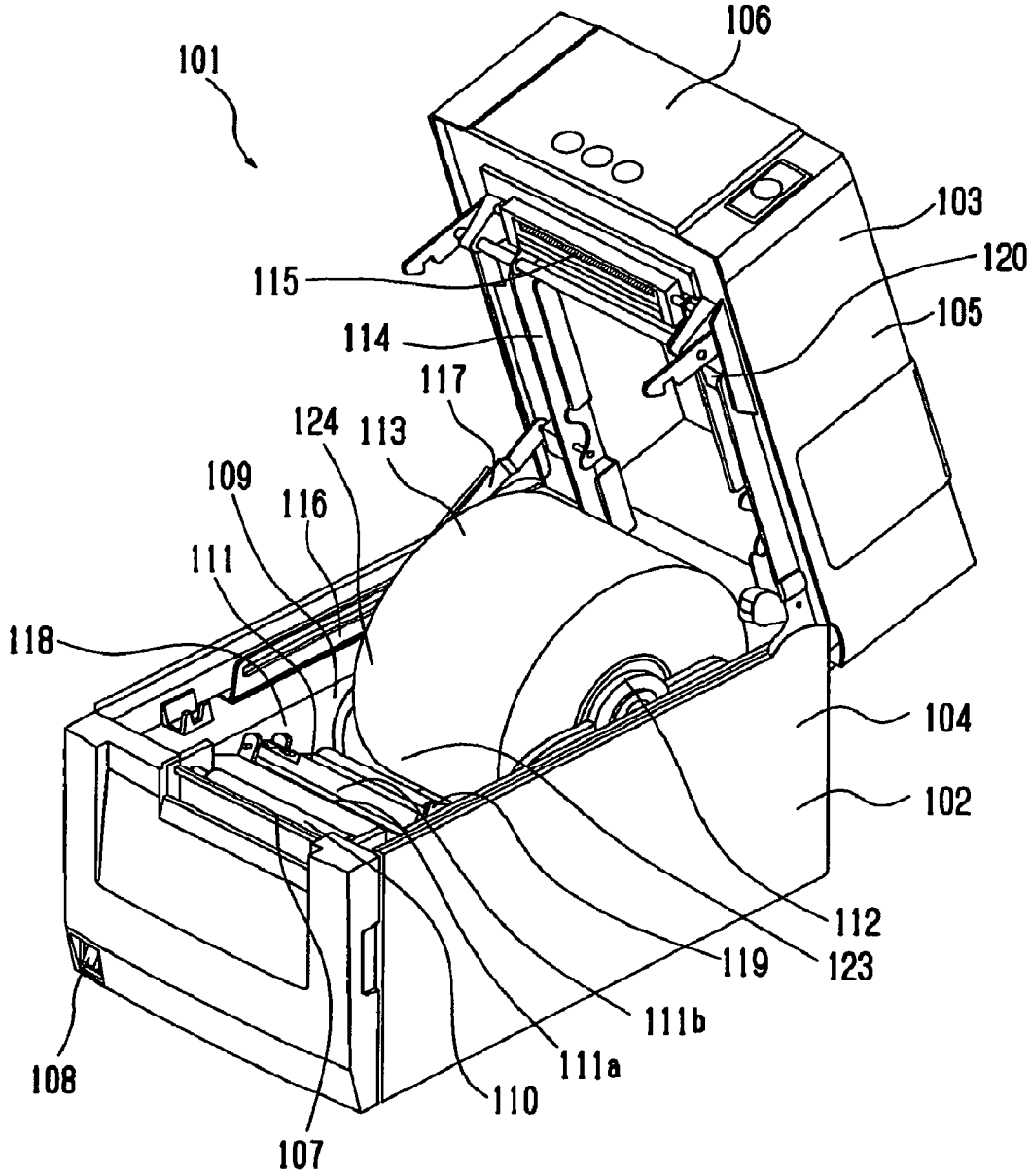
FIG. 2 is a perspective view of the printer with an upper unit opened.

FIG. 2 is a perspective view of the printer 101, showing a state in which the upper unit 103 is open. In the lower unit 102, the lower base unit 109 and various components, including a platen roller 110 and a sensor unit 111, are housed within the lower housing 104 whose upper side is open. A paper storage 124 is also provided in the interior of the lower housing 104 of the lower unit 102. The paper storage 124 includes a paper holder 112 for holding paper. Any of various types of paper may be used as necessary. For example, for allowing the printer to function as a label printer, label paper 113, comprising a long base paper and a large number of labels adhered thereto releasably, is used. The label paper 113 has a rolled shape. There are two types of label paper. One is inwards-wound label paper, another one is outwards-wound label paper. The inwards-wound label paper arranges labels inside of the wound long base. The outwards-wound label paper arranges labels outside of the wound long base. The printer 101 is able to use an inwards-wound label paper 113 and an outwards-wound label paper 113. The label paper 113 is held by the paper holder 112 and is accommodated rotatably in the interior of the paper storage 124.

In the upper unit 103, an upper base unit 114 and various components, including a printer head 115, are housed within the upper housing 105 whose lower side is open. The print head 115 constitutes a printing section together with the platen roller 110 installed in the lower unit 102. A thermal printing head, for instance, is used for the print head 115.

A paper path 123 is formed between the lower unit 102 and the upper unit 103. The paper path 123 extends from the paper storage 124 to the exterior through the issuing port 107. By opening the upper unit 103, the paper path 123 is opened. The platen roller 110 is disposed in the lower unit 102 and the print head 115 is disposed in the upper unit 103, the paper path 123 is also opened at the printing section by opening the upper unit 103.

On the other hand, even if the upper unit 103 is opened, the sensor unit 111 does not open with respect to the paper path 123. The sensor unit 111 opens the paper path 123 by a manual operation.

The upper unit 103 is provided with a mechanism (not shown) which can keep the upper unit open at a predetermined angle shown in FIG. 2 for instance. Therefore, even if an operator releases his or her hand from the upper unit 103 in the state shown in FIG. 2, this state is maintained.

Figure 3:
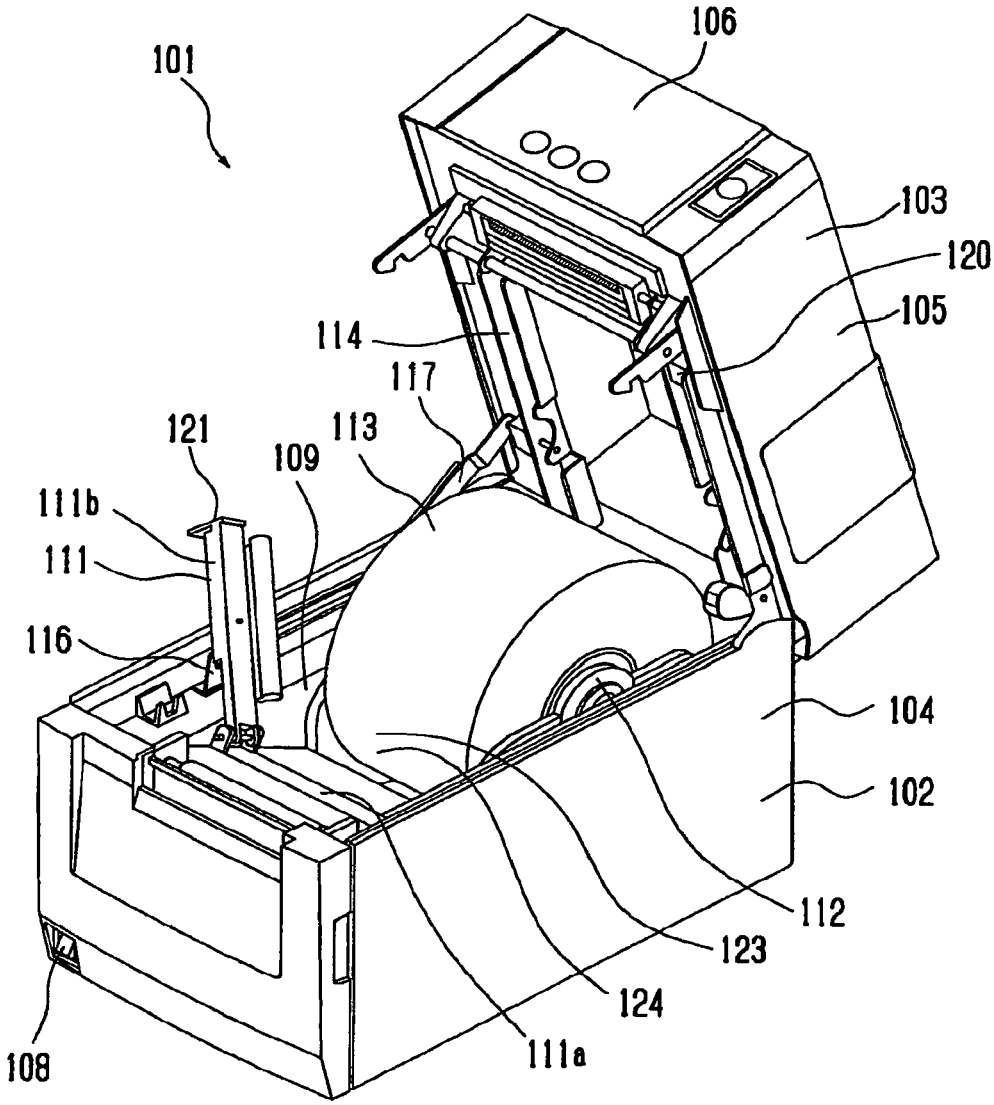
FIG. 3 is a perspective view of the printer, showing a state in which a paper sensor unit opens a paper path.

FIG. 3 is a perspective view of the printer 101, showing a state in which the sensor unit 111 opens the paper path 123. The sensor unit 111 is vertically divided into two and is made up of a lower sensor holder 111*a* and an upper sensor holder 111*b*. The lower sensor holder 111*a* is located at a lower position and the upper sensor holder 111*b* is located at an upper position. The paper path 123 is formed between the lower sensor holder 111*a* and the upper sensor holder 111*b*. Transmission type sensors TTS (see FIG. 17) are embedded in the lower and upper sensor holders 111*a*, 111*b*, respectively, at opposed positions via the paper path 123. The transmission type sensors TTS comprises a light emitting element LEE and a light receiving element LRE. One of the elements is embedded in the lower sensor holder 111*a* and the other embedded in the upper sensor holder 111*b*.

Figure 8A:
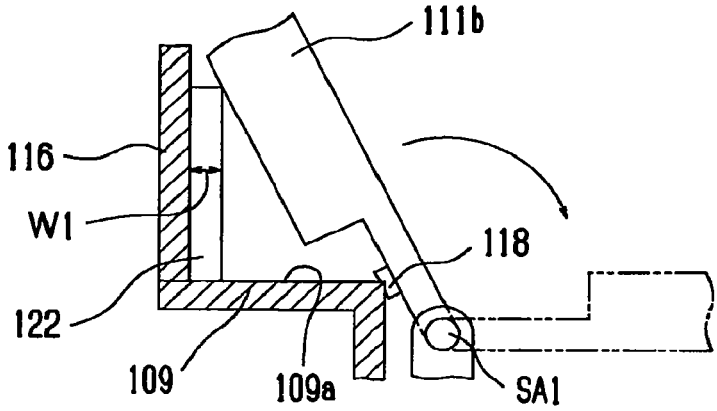
FIG. 8(A) is a front view in longitudinal section, showing schematically an upper sensor holder which is about to start a closing pivotal motion upon contact therewith of the slider lying in the position shown in FIG. 7(A)

The lower sensor holder 111*a* is attached to the lower base unit 109 detachably. The upper sensor holder 111*b* is attached to the lower sensor holder 111*a* so that it can open and close pivotably about a pivot shaft SA1 (see FIGS. 5(A), 5(B), FIGS. 8(A) to 8(C), and FIGS. 9(A), 9(B)) disposed on one side of the paper path 123 in the paper width direction. As shown in FIG. 8(A), when the upper sensor holder 111*b* opens pivotably at a predetermined angle (about 120°), it comes into abutment against a part of the lower base unit 109 and is retained in this position. This part of the lower base unit 109 is a corner of a stepped portion 109*a* formed in the lower base unit 109 while being positioned on the left side when seen from the front side of the printer 101. A support portion 118 is fixed to the upper sensor holder 111*b* at the position where the upper sensor holder 111*b* abuts against the corner of the stepped portion 109*a* of the lower base unit 109 (see FIG. 2 and FIGS. 8(A) to 8(C)). Such an abutting mechanism between a part of the lower base unit 109 and the support portion 118 of the upper sensor holder 111*b* constitutes a support mechanism which positions the pivotably opened upper sensor holder 111*b* at a predetermined angle.

Since the pivotal angle of the upper sensor holder 111*b* thus opened is about 120° relative to the lower sensor holder 111*a*, the free end of the upper sensor holder 111*b* protrudes to the outside of the lower housing 104. This state of the upper sensor holder 111*b* is designated an "open condition."

The upper sensor holder 111*b* is provided at its free end with a grip portion 119, which is grasped when pivotably opening or closing the upper sensor holder 111*b*. As shown in FIG. 2, the upper base unit 114 is provided with a pressing member 120 formed by a leaf spring in the vicinity of the printer head 115 and on the right side as seen from the front side of the printer 101. The pressing member 120 is positioned so as to push down the grip portion 119 with an elastic force when the upper unit 103 is closed.

The upper sensor holder 111*b* is also provided at its free end with a locking mechanism 121, which is described in detail below (see FIG. 9).

The lower sensor holder 111*a* and the upper sensor holder 111*b* are formed as resin-molded products. The support portion 118 and the grip portion 119 of the upper sensor holder 111*b* are also formed of resin.

Figure 4:
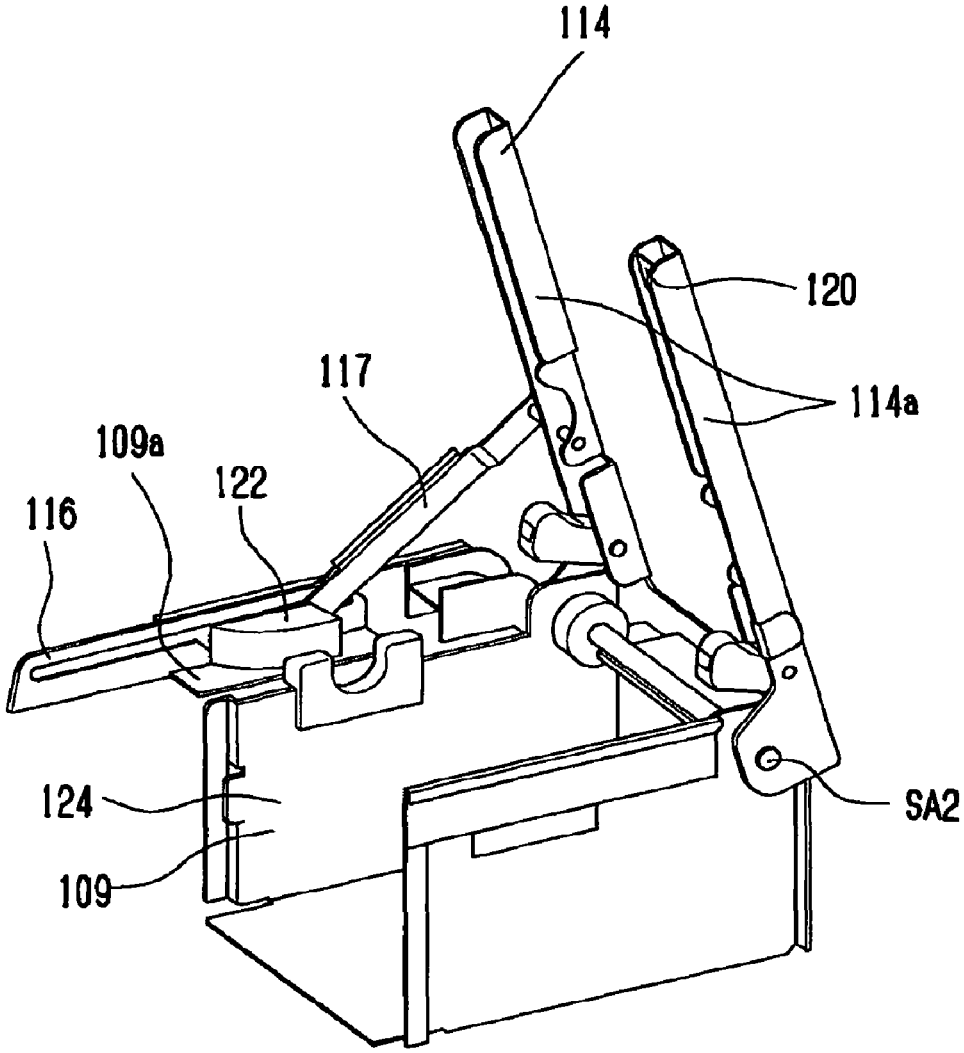
FIG. 4 is a perspective view of a part of a lower base unit and an upper base unit.

FIG. 4 is a perspective view of a part of the lower base unit 109 and the upper base unit 114. More specifically, FIG. 4 shows a state in which the upper unit 103 is open, and the lower housing 104, the upper housing 105 and a front part of the lower base unit 109 are removed from the printer 101. The upper base unit 114 is attached to a remaining part of the lower base unit 109 shown in FIG. 4 so as to be pivotable about a pivot shaft SA2 which is disposed at a rear position of the lower base unit 109. The upper base unit 114 is made up of a pair of support frames 114*a* which are mounted respectively on both sides of the lower base unit 109. The support frames 114*a* are fixed to the upper housing 105 of the upper unit 103. A pivotal center of the upper unit 103 is coincident with the axis of the pivot shaft SA2 which mounts the upper base unit 114 pivotably relative to the lower base unit 109.

A displacing mechanism is provided in the lower base unit 109 and the upper base unit 114. A main element of the displacing mechanism is a slider 122. More specifically, a long hole 116 is formed horizontally in the lower base unit 109 in a left side position as seen from the front side of the printer 101. The slider 122 is positioned inside the lower base unit 109 and is placed on the stepped portion 109*a* of the lower base unit 109. In this state, the lower base unit 109 is connected slidably to the long hole 116. A connecting portion 117 is pivotably connected at one end thereof to one support frame 114*a* and is pivotably connected at the other end to the connection of the slider 122 relative to the long hole 116.

Figure 5A:
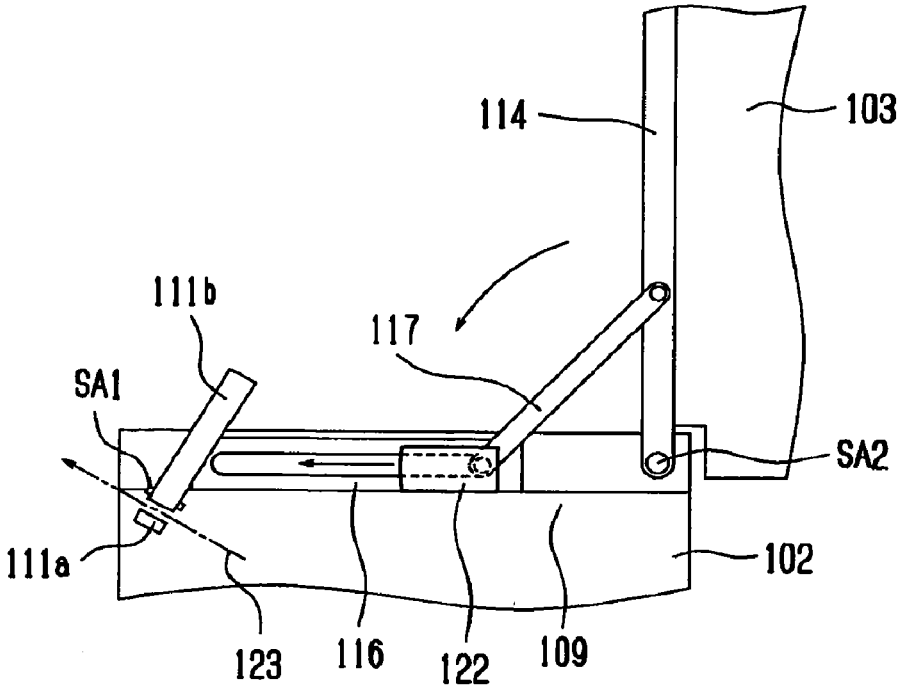
FIG. 5(A) is a side view showing the position of a slider in an open condition of the upper unit.
Figure 5B:
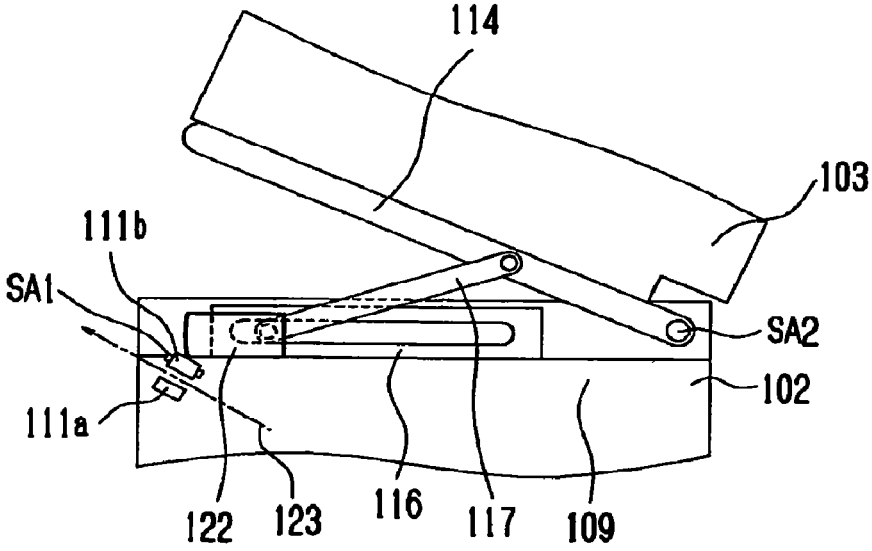
FIG. 5(B) is a side view showing the position of the slider which has slid forward in interlock with a closing pivotal motion of the upper unit.

FIG. 5(A) is a side view showing the position of the slider in an open condition of the upper unit 103. As shown in the same figure, when the upper unit 103 is open, the slider 122 is in a rear position of the long hole 116. As shown in FIG. 5(B), when the upper unit 103 is closed, a closing motion of the upper unit 103 is converted to a forward sliding motion of the slider 122 by the connecting portion 117 connected to the upper base unit 114, so that the slider 122 slides forward.

When the upper sensor holder 111*b* is in the "open condition", the upper sensor holder 111*b* keeping the paper path 123 open is pushed by the slider 122 and pivots in the direction to close the paper path 123, in accordance with movement of the upper unit 103 from its open condition shown in FIG. 5(A) to its closed condition shown in FIG. 5(B). As to the structure which brings about such an operation of the displacing mechanism, a description will be given later with reference to FIGS. 7(A) to 7(C) and FIGS. 8(A) to 8(C).

Figure 6:
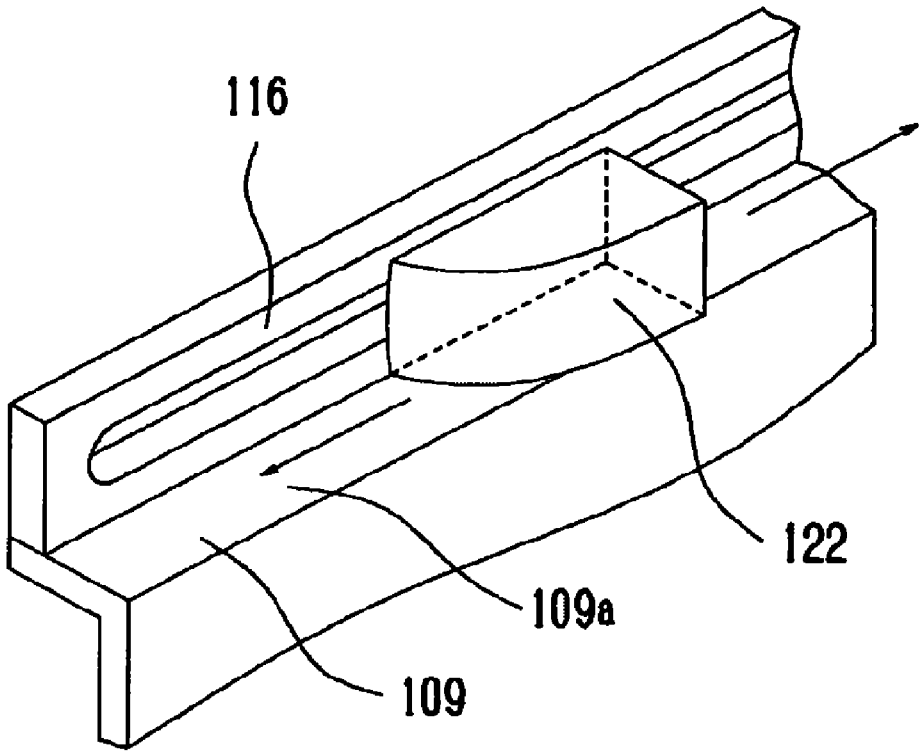
FIG. 6 is a perspective view of the slider.

FIG. 6 is a perspective view showing the slider 122. The slider 122 is formed as a resin-molded product and has a curved surface for contacting the upper sensor holder 111*b*. The curved surface of the slider 122 constitutes a cam which contacts to the upper sensor holder 111*b* in the "open condition" and urging to rotate the sensor holder 111*b* in direction of the "close condition".

Figure 7A:
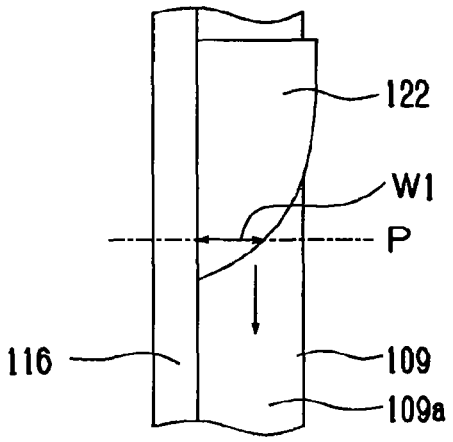
FIG. 7(A) is a plan view showing the slider located at a rear position.

FIG. 7(A) is a plan view showing the slider 122 located at a rear position. Since the surface of the slider 122 which surface comes into contact with the upper sensor holder 111*b* is a curved surface, the width (thickness) at a certain position P varies depending on the position of the slider as it moves. The certain position P corresponds for example to the position where the forwardly moving slider 122 first contacts the upper sensor holder 111*b*.

Figure 7B:
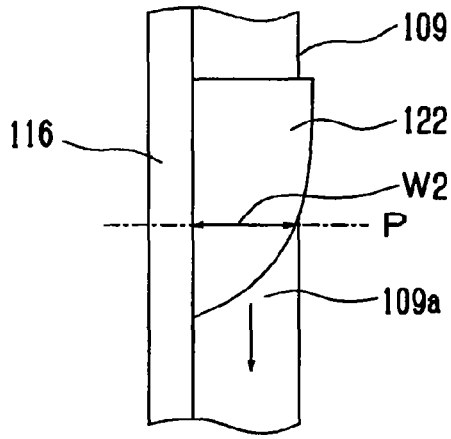
FIG. 7(B) is a plan view showing a state in which the slider has moved to a more forward position.

FIG. 7(B) is a plan view showing a state in which the slider 122 has moved more in the forward direction. When the slider 122 is at the position shown in FIG. 7(A), the width of the slider 122 at the position P is the width W1, while when the slider 122 moves to the position shown in FIG. 7(B), the width of the slider at the position P becomes a larger width W2.

Figure 7C:
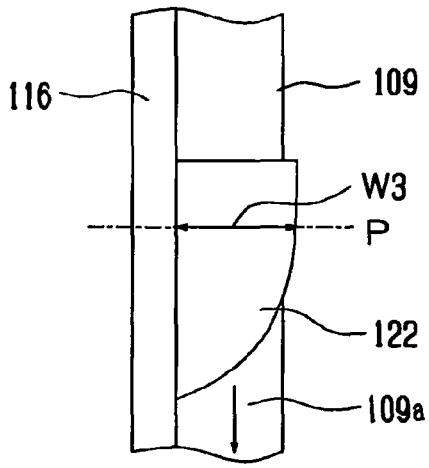
FIG. 7(C) is a plan view showing a state in which the slider has moved to a still more forward position.

FIG. 7(C) is a plan view showing a state in which the slider 122 has moved still more in the forward direction. When the slider 122 lies at the position shown in FIG. 7(B), the width of the slider at the position P is the width W2, while when the slider 122 moves to the position shown in FIG. 7(C), the width of the slider becomes a still larger width W3. The width W3 is the largest width of the slider 122.

FIG. 8(A) is a front view in longitudinal section, showing schematically the upper sensor holder 111*b* which is about to start a closing pivotal motion upon contact therewith of the slider 122 lying at the position shown in FIG. 7(A). The upper sensor holder 111*b* is maintained in the "open condition" in which the support portion 118 is in abutment against a corner of the stepped portion 109*a* of the lower base unit 109. In this state, the slider 122 which moves forward in interlock with the closing pivotal motion of the upper unit 103 gets into the gap formed between the upper sensor holder 111*b* and the connecting portion 117. At this time, the width of the slider 122 at the position P is W1, and the slider 122 is in a state of not having yet come into contact with the upper sensor holder 111*b* which is in the "open condition", or is in a state of having begun to contact the upper sensor holder 111*b* which is in the "open condition".

Figure 8B:
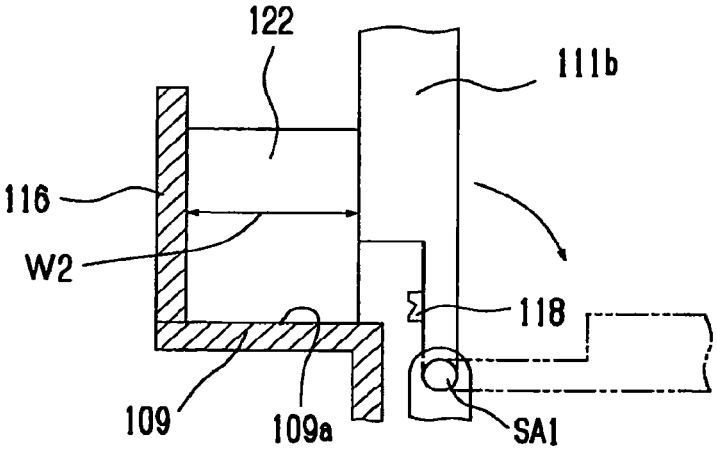
FIG. 8(B) is a front view in longitudinal section, showing schematically the upper sensor holder which is performing a closing pivotal motion upon contact therewith of the slider lying in the position shown in FIG. 7(B)

FIG. 8(B) is a front view in longitudinal section, showing schematically the upper sensor holder 111*b* which is performing the closing pivotal motion by contact therewith of the slider 122 lying at the position shown in FIG. 7(B). As shown in FIG. 8(B), when the slider 122 moves more forward, the width of the slider 122 at the position P expands to the width W2, so that the slider 122 contacts the upper sensor holder 111*b* and pushes the upper sensor holder 111*b* in its closing direction. In the state shown in FIG. 8(B), the upper sensor holder 111*b* is in a substantially vertical state.

Figure 8C:
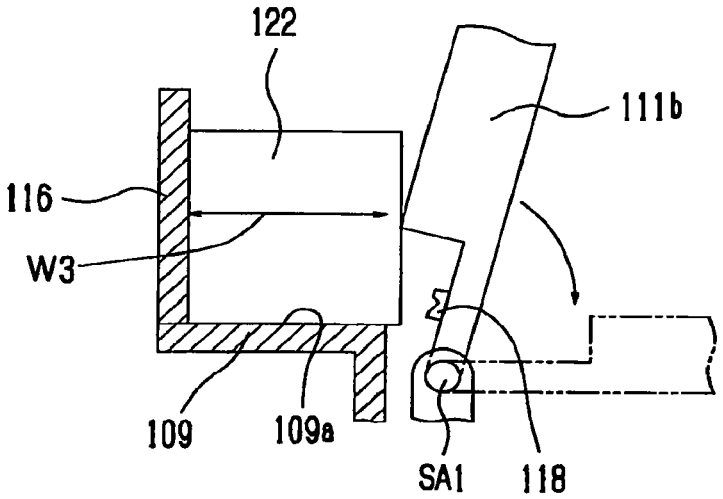
FIG. 8(C) is a front view in longitudinal section, showing schematically the upper sensor holder which is starting a closing pivotal motion by its own weight upon contact therewith of the slider lying in the position shown in FIG. 7(C)

FIG. 8(C) is a front view in longitudinal section, showing schematically the upper sensor holder 111*b* which is starting its closing motion by its own weight upon contact therewith of the slider 122 lying at the position shown in FIG. 7(C).

As shown in FIG. 8(C), as the slider 122 moves still more forward, the width of the slider 122 at the position P expands to the width W3, so that the slider 122 further pushes the upper sensor holder 111*b*, whereby the sensor holder 111*b* is pushed until the angle between it and the lower sensor holder 111*a* becomes an acute angle. Consequently, the upper sensor holder 111*b* drops rotationally by its own weight about the pivot shaft SA1 so as to approach the lower sensor holder 111*a*.

A buffer member for avoiding damage caused by collision may be provided on the upper sensor holder 111*b* at the position where the upper sensor holder comes into contact with the slider 122. The buffer member may be a leaf spring having resilience.

The material and shape of the slider 122 shown in this embodiment are only an example and no limitation is made thereto insofar as it is possible to create an external force for displacing the upper sensor holder 111*b* which is in the "open condition," as shown in FIG. 8.

Figure 9A:
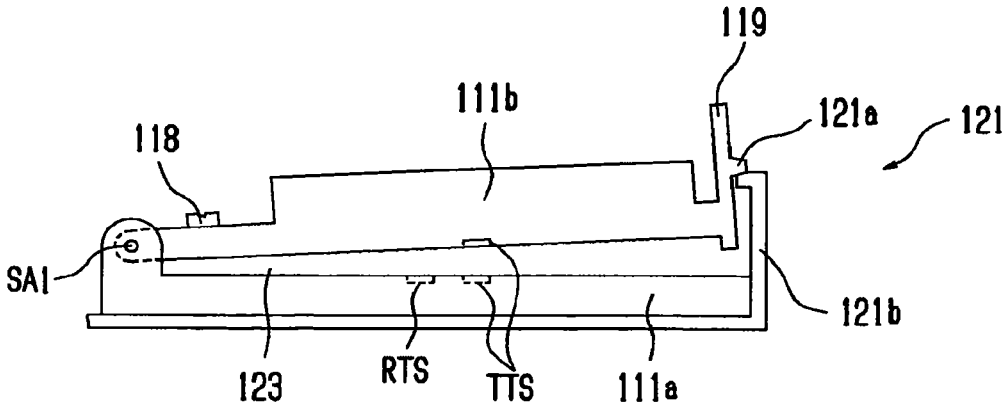
FIG. 9(A) is a front view of a lock mechanism, showing an unlocked state of the upper sensor holder.

FIG. 9(A) is a front view of the locking mechanism 121, showing an unlocked state of the upper sensor holder 111*b*. As described above, the locking mechanism 121 is provided at the free end of the upper sensor holder 111*b* to lock the upper sensor holder 111*b* to the lower sensor holder 111*a*. The locking mechanism 121 is made up of a projection 121*a* as a to-be-retained portion formed at the free end of the upper sensor holder 111*b* and a retaining portion 121*b* provided on the side of the sensor unit 111 with the lower sensor holder 111*a*. By engagement of the projection 121*a* with the retaining portion 121*b*, the upper sensor holder 111*b* is locked to the lower sensor holder 111*a*. The projection 121*a* of the upper sensor holder 111*b* is formed as a resin-molded product made of resin and the retaining portion 121*b* is also formed as a resin-molded product. The retaining portion 121*b* made of resin has elasticity and, when an external force is applied so as to push in the vicinity of the free end of the upper sensor holder 111*b*, the retaining portion 121*b* is pushed by the free end of the upper sensor holder 111*b* and deflects so as to permit engagement thereof with the projection 121*a*. As a result, the projection 121*a* is fitted in the retaining portion 121*b* and the upper sensor holder 111*b* is locked.

Figure 9B:
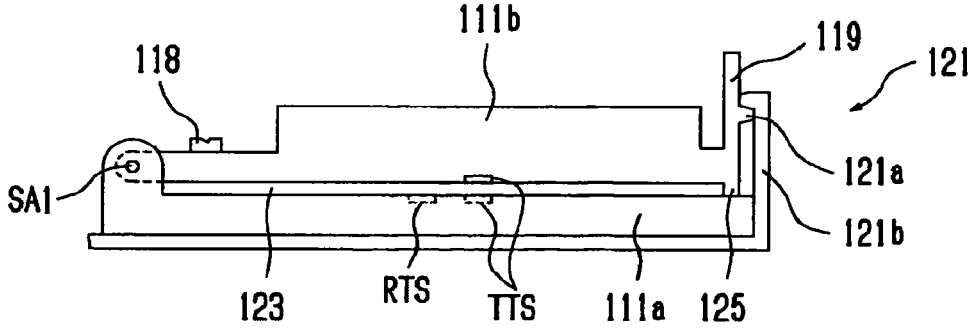
FIG. 9(B) is a front view of the lock mechanism, showing a locked state of the upper sensor holder.

FIG. 9(B) is a front view of the locking mechanism 121, showing a locked state of the upper sensor holder 111*b*. The locked state by the locking mechanism 121 can be released by deflecting the grip portion 119, which is made of resin and has elasticity, toward the pivot shaft SA1 of the upper sensor holder 111*b*. When the projection 121*a* is disengaged from the retaining portion 121*b*, the locked state by the locking mechanism 121 is released and the upper sensor holder 111*b* becomes pivotable.

As shown in FIG. 9(B), a spacer 125 projects from the underside on the free end side of the upper sensor holder 111*b*. With the upper sensor holder 111*b* closed and locked by the locking mechanism 121, the spacer 125 comes into abutment against the lower sensor holder 111*a*, whereby an appropriate space is formed for the paper path 123 between the lower sensor holder 111*a* and the upper sensor holder 111*b*.

The engaging motion of the projection 121*a* with the retaining portion 121*b* in the locking mechanism 121 will now be described in more detail. As shown in FIG. 8(C), even if the upper sensor holder 111*b* is dropped rotationally by applying an external force thereto, the projection 121*a* is not brought into engagement with the retaining portion 121*b*, but the upper sensor holder 111*b* assumes a pre-lock state in which it is slightly with respect to the lower sensor holder 111*a* as in FIG. 9(A). The pre-lock state is defined as a state in which the retaining portion 121*b* supports the projection 121*a* and the upper sensor holder 111*b* keeps the paper path 123 slightly opened. When the upper sensor holder 111*b* is in its pre-lock state, the upper sensor holder 111*b* can be brought into its locked state easily by pushing the upper sensor holder in the vicinity of the free end thereof from above.

The upper base unit 114 is provided with the pressing member 120 described above. The pressing member 120 is positioned so that, when the upper unit 103 is closed, the pressing member 120 comes into contact with the grip portion 119 of the upper sensor holder 111*b*, which is in the state shown in FIG. 9(A). When the upper unit 103 is closed, the pressing member 120 pushes down the grip portion 119. In this case, the urging force is set to a sufficient force for locking the upper sensor holder 111*b*. Thus, even if the operator forget to depress the upper sensor holder 111*b* into the locked state, by merely closing the upper unit 103, the pressing member 120 depresses the grip portion 119 and the upper sensor holder 111*b* can be locked. Besides, by using the pressing member 120 as a resilient member at the position of contact with the grip portion 119, it is possible to avoid damage of the grip portion 119 caused by the contact.

According to this embodiment, as set forth above, when the upper unit 103 is opened for replacement of the label paper 113 and the upper sensor holder 111*b* of the sensor unit 111 is opened to open the paper path 123, the opened upper sensor holder 111*b* performs its closing pivotal motion by merely closing the upper unit 103 after the end of a paper setting work. Therefore, it is possible to prevent the upper sensor holder 111*b* from being pinched and damaged between the lower unit 102 and the upper unit 103. In this case, by merely closing the upper unit 103, the locking mechanism 121 in the upper sensor holder 111*b* is also locked, so that it is possible to avoid forgetting to lock the sensor unit 111. Consequently, after setting the label paper 113 to the paper path 123, the printer 101 can be immediately brought into an employable state by merely closing the upper unit 103.

The printer 101 of this embodiment further includes a damper mechanism. A description will be given below about the damper mechanism with reference to FIGS. 10 and 11.

Figure 10:
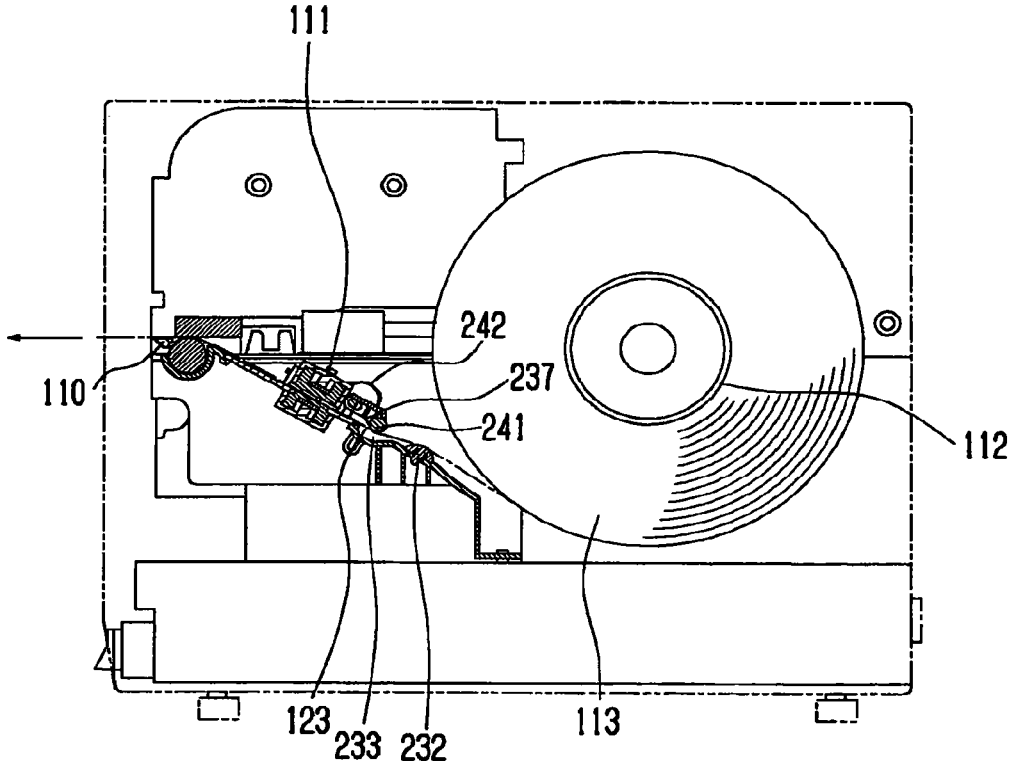
FIG. 10 is a side view in longitudinal section, showing a state in which inwards-wound label paper is set.
Figure 11:
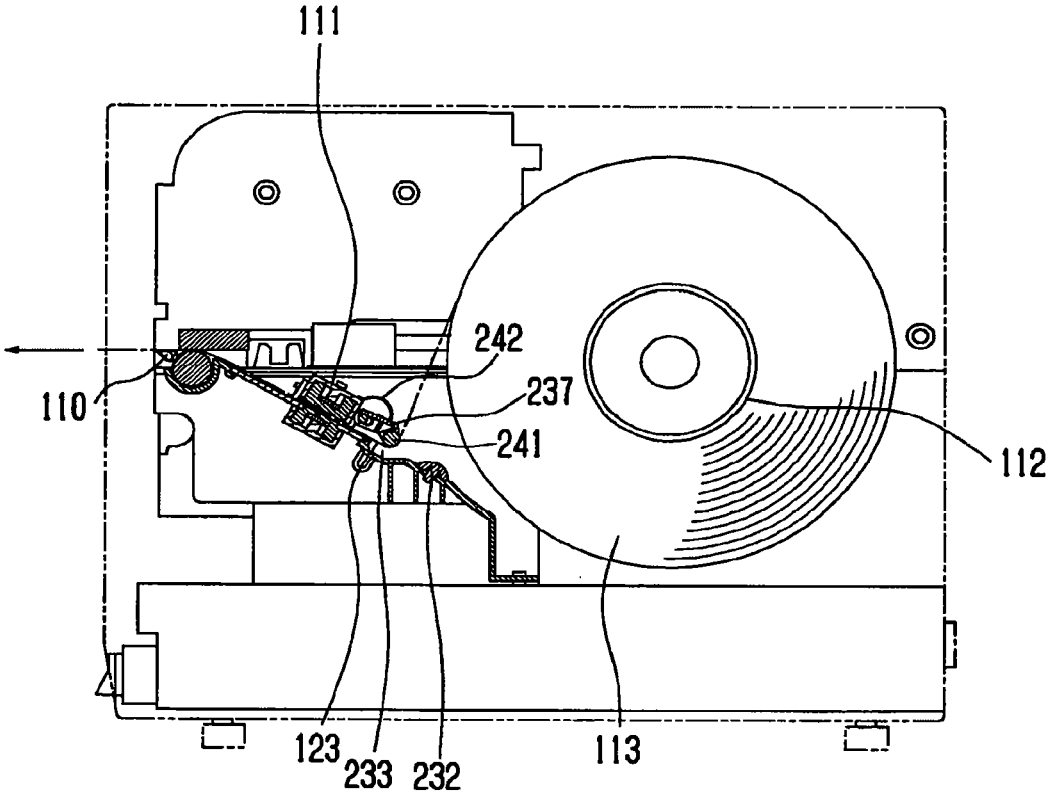
FIG. 11 is a side view in longitudinal section, showing a state in which outwards-wound label paper is set.

FIG. 10 is a side view in longitudinal section, showing a state in which the inwards-wound label paper 113 is set and FIG. 11 is a sectional view in longitudinal section, showing a state in which the outwards-wound label paper 113 is set. There are two modes of use of the label paper 113. One is inwards-wound mode in which the inwards-wound paper 113 is drawn out from the lower side of the roll and is passed through the paper path 123, and another one is outwards-wound mode in which the outwards-wound paper 113 is drawn out from the upper side of the roll and is passed through the paper path 123. The paper path 123 is provided with a semicircular projecting portion 232 which, in the inwards-wound state of paper, is sure to contact the drawn-out label paper 113 in the case where the diameter of the rolled portion of the label paper 113 is larger than a predetermined value. Downstream of the projecting portion 232 is formed a recess 233 having a predetermined depth. Further, downstream of the recess 233 is disposed the sensor unit 111, the sensor unit 111 being mounted so that it can open and close in a direction orthogonal to the advancing direction of the label paper 113 passing through the paper path 123.

Figure 12:
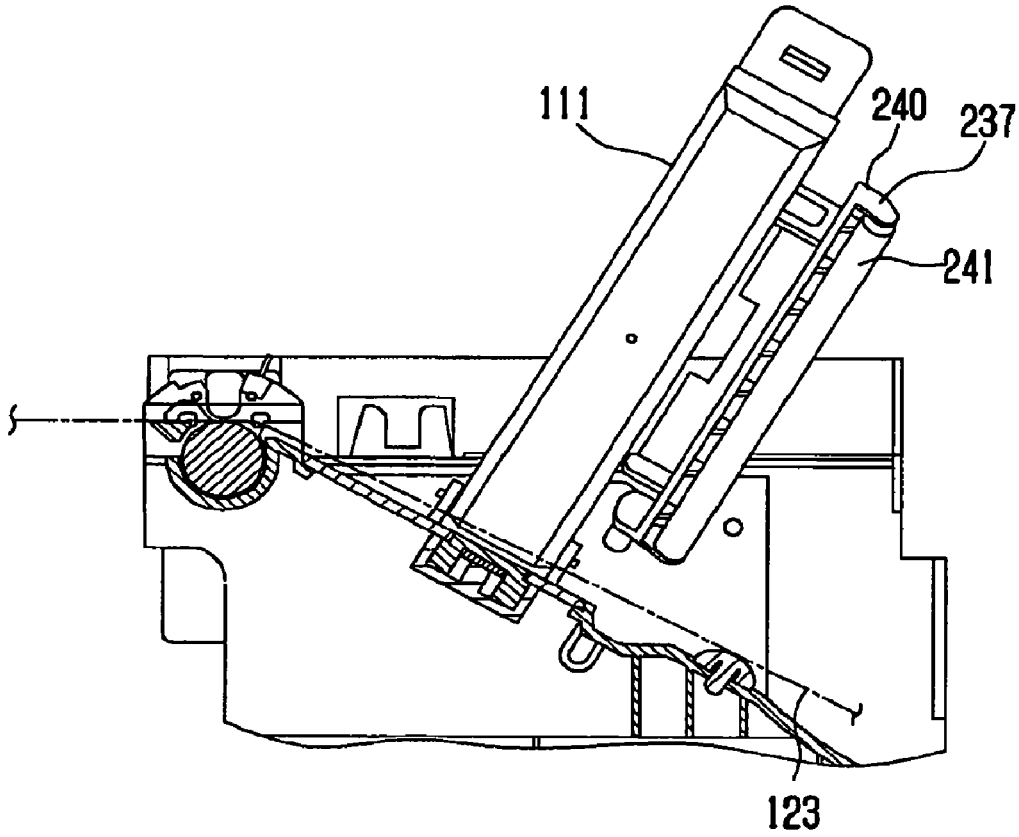
FIG. 12 is a side view in longitudinal section in an open condition of the sensor unit.
Figure 13:
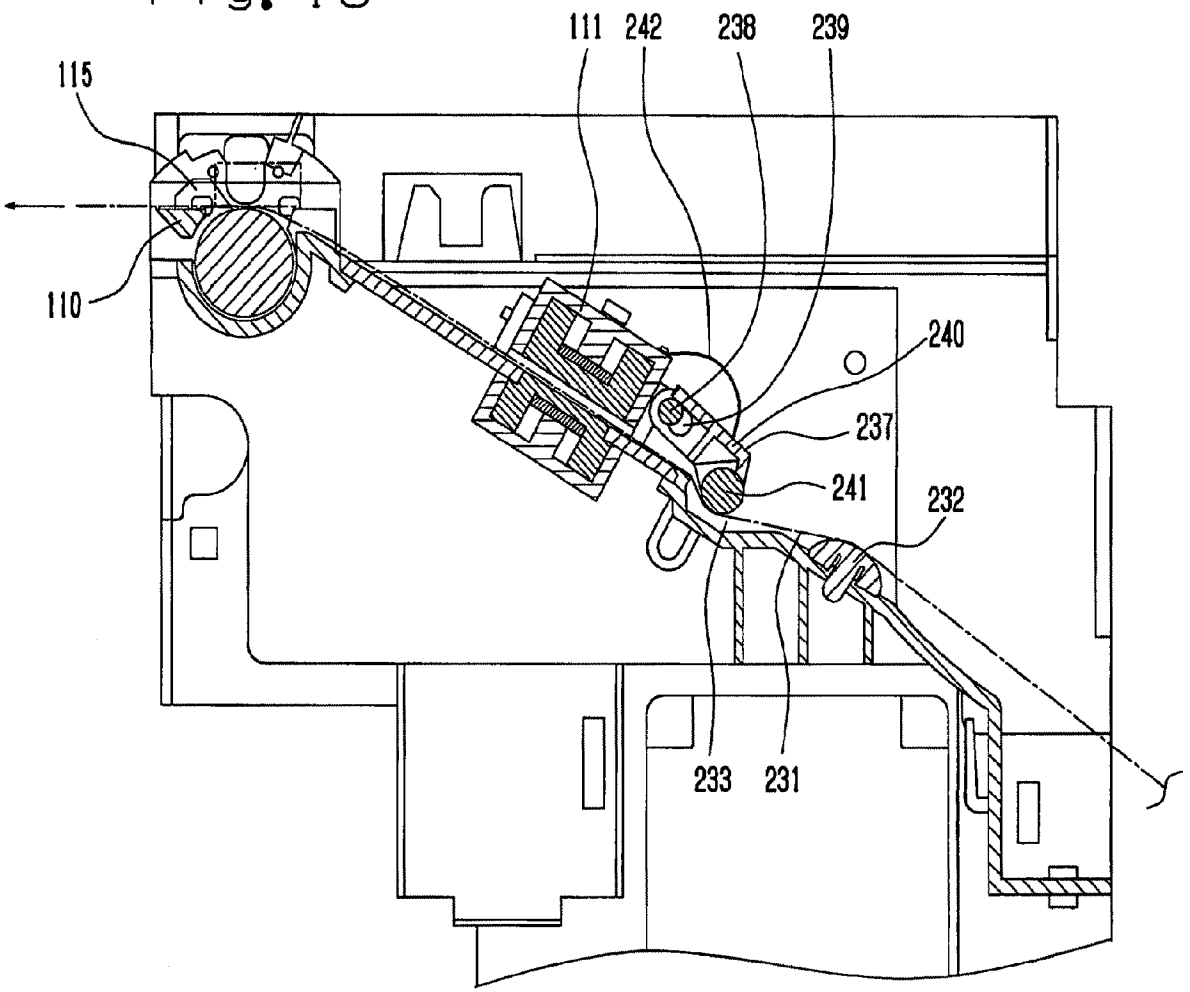
FIG. 13 is a side view in longitudinal section in a state in which no tension is exerted on label paper.
Figure 14:
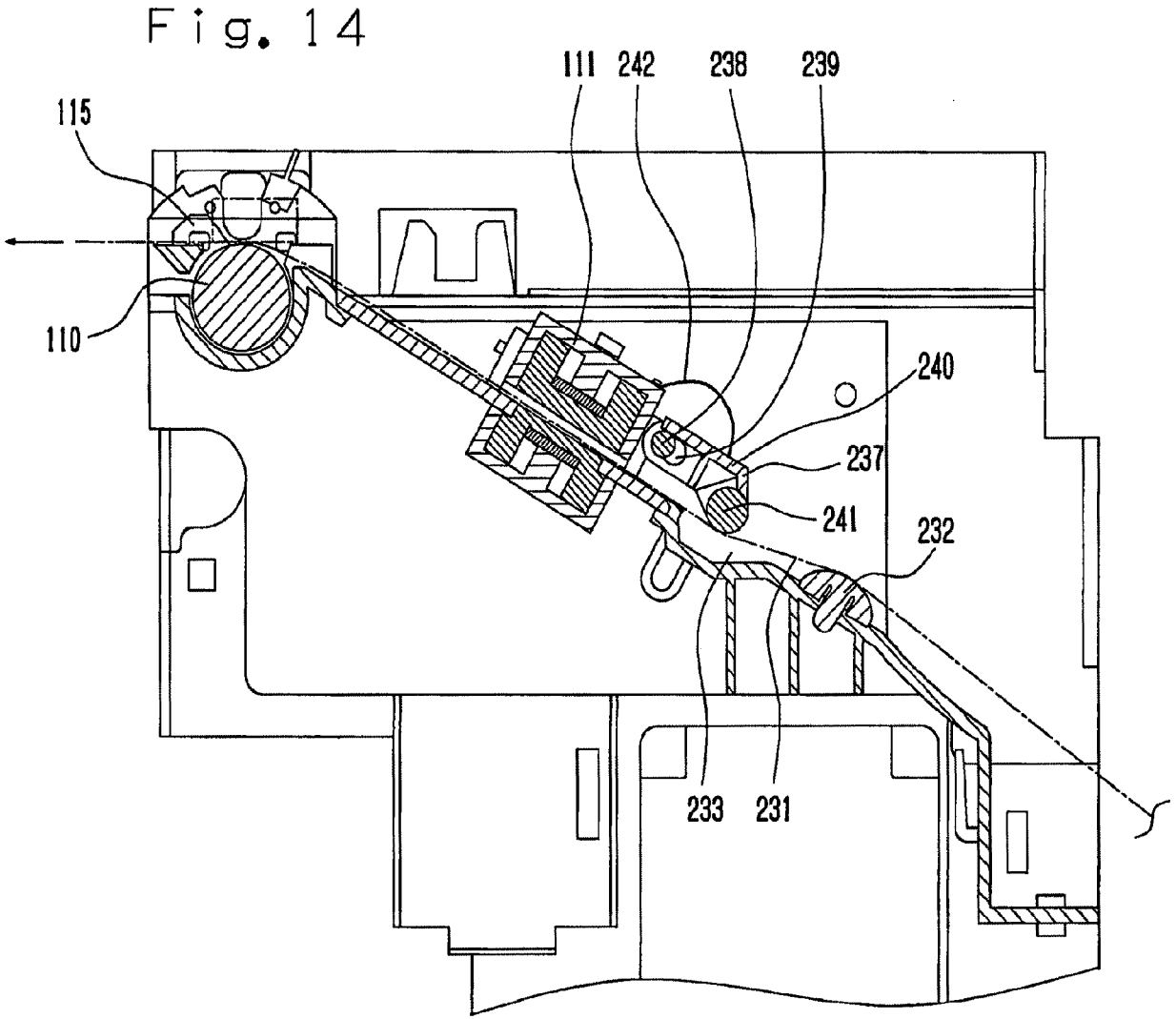
FIG. 14 is a side view in longitudinal section in a state in which tension is exerted on label paper.

FIG. 12 is a side view in longitudinal section, showing a state in which the sensor unit 111 is open, FIG. 13 is a side view in longitudinal section, showing a state in which no tension is exerted on the label paper 113, and FIG. 14 is a side view in longitudinal section, showing a state in which tension is exerted on the label paper 113. A damper mechanism 237 is integrally provided on the same side of the sensor unit 111 as the projecting portion 232. The damper mechanism 237 is made up of a tension holder 240, which includes an axial bore 239 formed to long in the horizontal direction and adapted to fit on a pivot shaft 238 provided in the sensor unit 111, a tension roller 241 mounted pivotably to the tension holder 240, and a tension spring 242 which urges the tension holder 240 downward. The tension spring 242 is formed by a semicircularly curved thin plate. One end of the tension spring 242 is fixed to the sensor unit 111, while the other end thereof is a free end. The damper mechanism is constructed so that the free end of the tension spring 242 permits abutment thereagainst of the tension holder 240. Therefore, the tension spring 242 not only pushes out the tension holder 240 toward the projecting portion 232 but also urges it downward about the pivot shaft 238, i.e., clockwise in the state of FIGS. 13 and 14. As a result, when the label paper 113 is set in its inwards-wound state and with no tension exerted on the label paper 113, the tension holder 240 falls into the recess 233 and causes the label paper 113 to bend.

A description will now be given about the operation of the damper mechanism 237. For setting the label paper 113, first the upper unit 103 is opened to open the upper surface of the lower unit 102. Then, the upper sensor holder 111*b* of the sensor unit 111 is opened to open the portion which overlies the paper path 123. In this state, the rolled label paper 113 is set to the paper storage 124 from above. At this time, either the inwards- or the outwards-wound mode can be selected. The unwinding direction of the label paper 113 differs depending on whether the paper set mode is the inwards- or the outwards-wound mode and therefore care must be exercised at the time of setting the label paper 113. In the inwards-wound mode, the paper is drawn out in the direction shown in FIG. 10, while in the outwards-wound mode, the paper is drawn out in the direction shown in FIG. 11. In the inwards-wound mode, if the label paper 113 is used and has a large roll diameter, the label paper comes into contact with the projecting portion 232, while in the outwards-wound mode, the label paper does not contact the projecting portion 232. In any event, the label paper 113 is drawn out until the tip thereof reaches a position outside the issuing port 107 and is set to the paper path 123. In this state, the upper sensor holder 111*b* of the sensor unit 111 is brought down and set to its regular position, and then the upper unit 103 is closed.

With the upper unit 103 closed and with the label paper 113 in the inwards-wound mode, the tension roller 241 in the damper mechanism 237 pushes the label paper 113 with the force of the tension spring 242, causing the paper to fall into the recess 233 and thereby allowing the paper to assume a bent state. In the outwards-wound mode, the label paper 113 is in a wound-up state around the tension roller 241 and is largely bent at this portion, and the tension roller 241 is moved upstream with the tension spring 242. When the upper unit 103 is closed into a printable state, the sensor unit 111 is also set to its regular position. The damper mechanism 237 is also integral with the sensor unit 111, so in the printable state the damper mechanism 237 is sure to operate.

After the label paper 113 is set, a printing operation is started. During printing, the motion of the label paper 113 is intermittent. That is, since the feed of paper is not performed in a continuous manner, the rolled portion of the label paper 113 also repeats rotations and stops in an intermittent manner. For example, when the feed of paper for printing stops, the rolled portion of the label paper 113 stops after rotating to a certain degree by the force of inertia, so that the label paper 113 present in the paper path 123 is in a state having slackness. Therefore, when the label paper 113 is fed for the next printing, for the feed quantity corresponding to that slackness, the paper is fed at an exact feed rate because of low resistance to the feeding, but when the slackness is exhausted it is required to rotate the rolled portion of the label paper 113, with a consequent increase in resistance to the feeding. In this case, tension is developed in the label paper 113 and the tension roller 241 in the damper mechanism 237 moves against the force of the tension spring 242 and performs a buffering action to prevent an abrupt generation of tension. Then, tension increases slowly and causes the rolled portion of the label paper 113 to rotate, so that the feed rate of the label paper in the printing section does not change. That is, the damper mechanism 237 attached to the sensor unit 111 not only causes bending of a part of the label paper 113 set to the paper path 123 but also diminishes the degree of bending of the label paper 113 in accordance with the tension applied to the same paper. The buffering action thus exhibited will be described below in each of the inwards- and outwards-wound modes.

In the inwards-wound mode, the paper portion corresponding to the bent length in the recess 233 contributes to the buffering action. That is, the tension roller 241 moves upward against the force of the tension spring 242, causing a buffering action to be exhibited to a degree corresponding to the bent length. At this time, if the diameter and weight of the rolled portion of the label paper 113 are large, the bent length in the recess 233 is ensured because the paper is sure to contact the projecting portion 232, thus ensuring a satisfactory buffering action. As the diameter of the rolled portion of the label paper 113 becomes smaller, the label paper 113 is no longer in contact with the projecting portion 232, but in this case the weight of the paper rolled portion becomes smaller and so there occurs no problem even if the buffering action during the feeding of the paper is weak.

In the outwards-wound mode, even with an increase of tension acting on the label paper 113, there occurs a buffering action because the tension roller 241 moves forward against the tension of the tension spring 242, thus preventing the occurrence of any large change in tension. In the case where the printing operation continues for a long time, the tension roller 241, in both inwards- and outwards-wound modes, reverts to its original position with the force of the tension spring 242 during the printing operation.

Thus, with the damper mechanism 237, the feed rate of the label paper 113 can be kept constant and a highly accurate printing operation can be effected even when the line width and line spacing are strict as is the case with bar code printing.

It should be noted that the damper mechanism 237 is advantageously attached to the sensor unit 111. In this embodiment, when the upper unit 103 is closed, the upper sensor holder 111*b* of the sensor unit 111 is sure to be brought into its closed regular position. It follows that the damper mechanism 237 is sure to be in operation while the printing operation is performed.

Moreover, as described previously, the label paper 113 is wound in a rolled state and the damper mechanism 237 contacts the label paper 113 at the same position in both the case where the label paper 113 is set along the inwards-wound path and the case where it is set along the outward-wound path. Thus, it is easy to make the selection between the inwards- and outwards-wound paper feed modes.

Further, since the projecting portion 232 is formed in the paper path 123 to keep the label paper 113 bent by the damper mechanism 237 even when the winding diameter of the label paper held in a paper storage 124 is large, there does not occur a difference in the buffering action depending on the size of the rolled portion of the label paper.

In the printer 101 of this embodiment, the sensor unit 111 is unitized and is attached to the lower base unit 109 detachably. Now, with reference to FIGS. 15 to 20, the following description is provided about the structure for mounting and dismounting the sensor unit 111.

Figure 15:
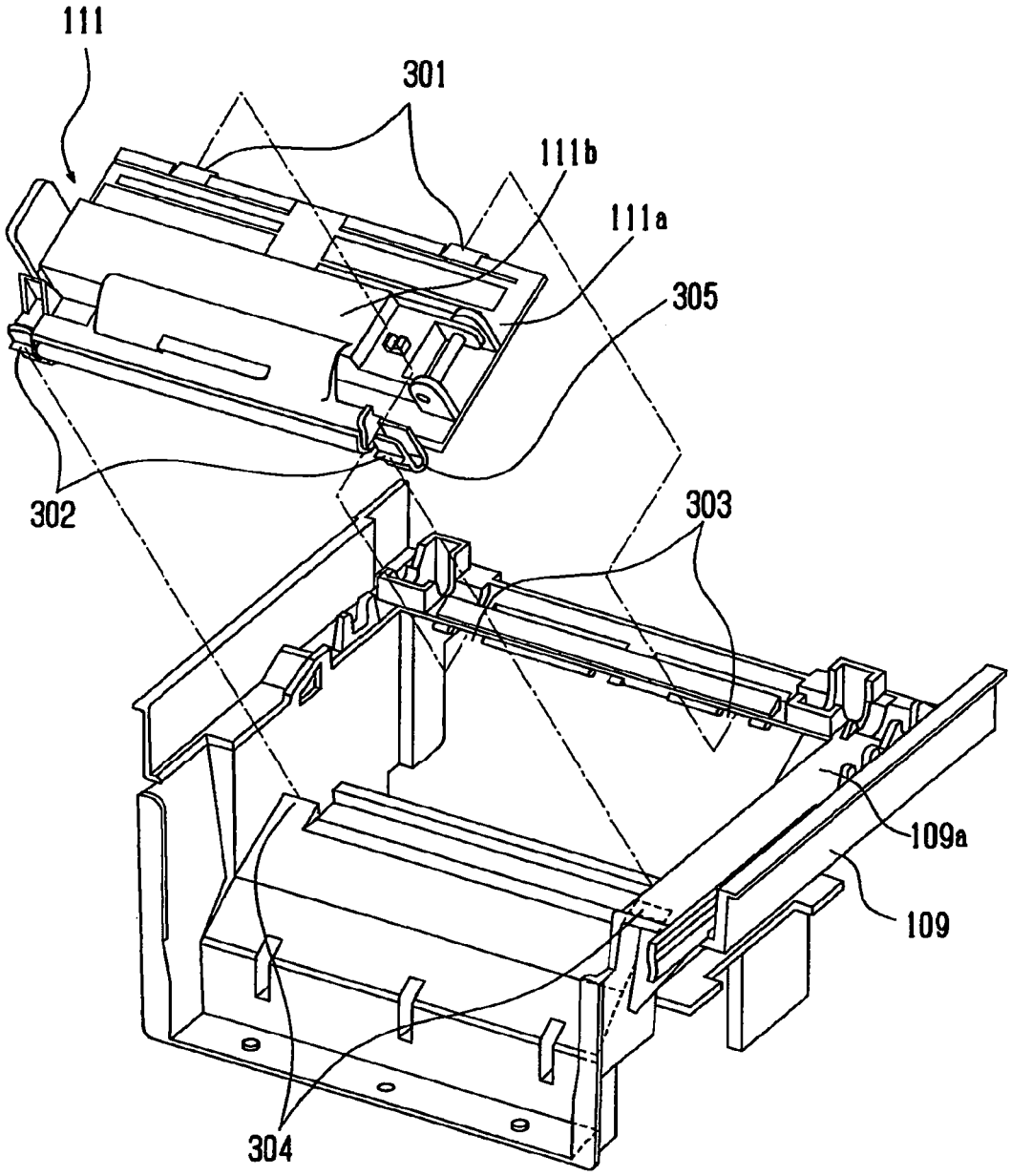
FIG. 15 is an exploded perspective view of the lower base unit and the sensor unit.

FIG. 15 is an exploded perspective view showing the lower base unit 109 and the sensor unit 111. The lower base unit 109 shown in FIG. 15 corresponds to another part of the lower base unit 109 shown in FIG. 4. More specifically, the part of the lower base unit 109 shown in FIG. 4 is a part of the rear portion of the lower base unit 109, and a part of the front portion of the lower base unit 109 connected thereto is shown in FIG. 15. As described earlier, the lower base unit 109 is accommodated and fixed in the interior of the lower unit 102. The sensor unit 111 is attached to the lower base unit 109 detachably.

Mounting and dismounting of the sensor unit 111 relative to the lower base unit 109 are performed by a structure wherein two pairs of retaining pawls 301 and 302 provided in the sensor unit 111 are engaged with two pairs of retaining portions 303 and 304 provided in the lower base unit 109. More specifically, the sensor unit 111 has a pair of retaining pawls 301 provided at front positions and a pair of retaining pawls 302 provided at rear corner positions, while the lower base unit 109 has a pair of retaining portions 303 and a pair of retaining portions 304 engageable respectively with the retaining pawls 301 and 302. Since the retaining pawls 301 and 302 are engaged with the retaining portions 303 and 304 disengageably, the sensor unit 111 is attached to the lower base unit 109 detachably and is disposed at a fixed position.

One pair of retaining pawls 302 provided in the sensor unit 111 have U-bent projecting portions 305. The U-bent portions 305 are formed by molding integrally with the lower sensor holder 111*a*, which is formed as a resin-molded product, and therefore have elasticity.

Figure 16:
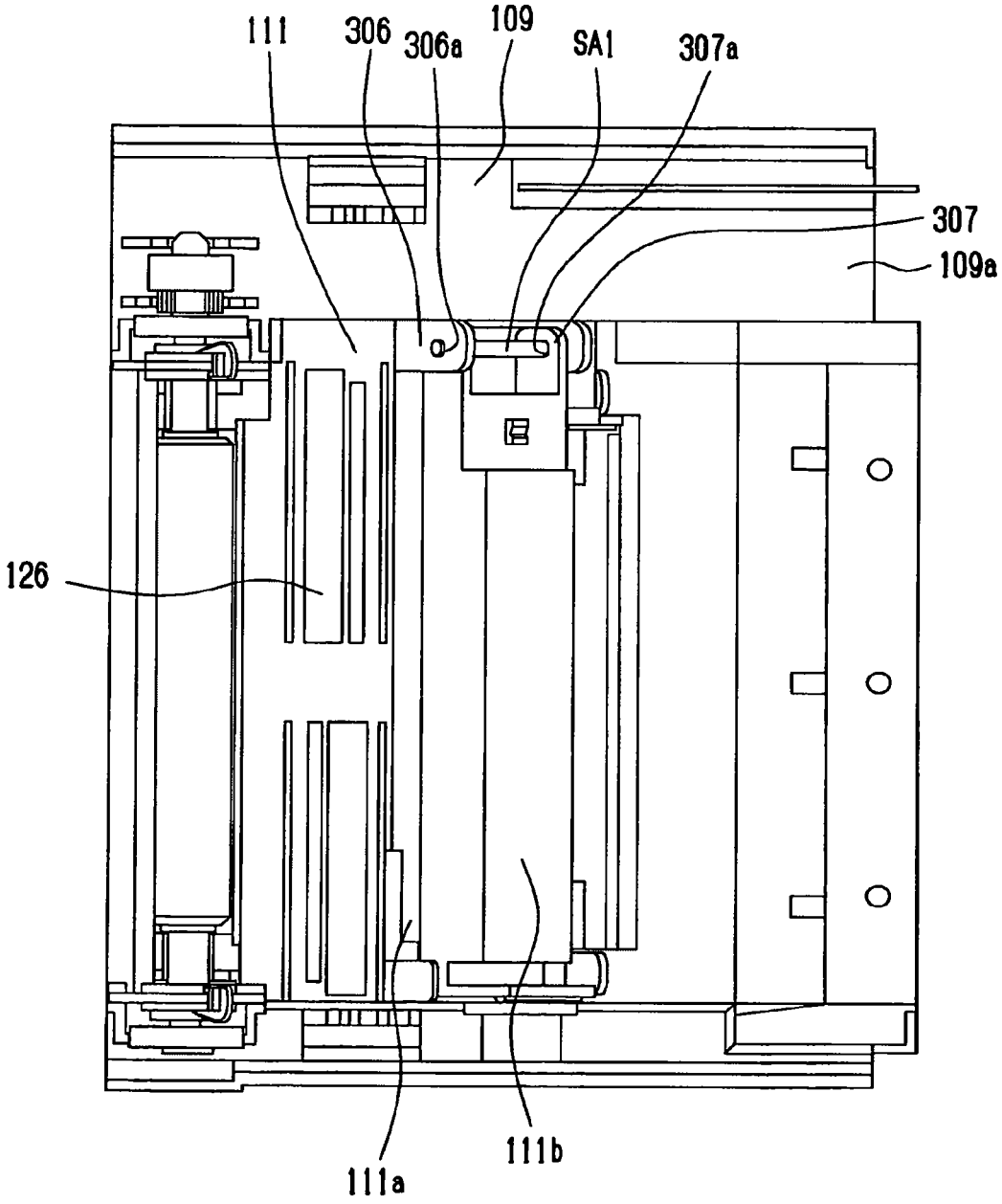
FIG. 16 is a plan view of the lower base unit.

FIG. 16 is a plan view showing the sensor unit 111 attached to the lower base unit 109. As described above, the upper sensor holder 111*b* can open and close pivotably relative to the lower sensor holder 111*a*, centered on the pivot shaft SA2 which is disposed at one end in the longitudinal direction (a direction orthogonal to the direction in which the label paper 113 is conveyed along the paper conveyance path 123) of the sensor unit 111. The paper conveyance path 123 is opened by an opening pivotal motion of the upper sensor holder 111*b*. More particularly, a pair of lower shaft holders 306 project from the lower sensor holder 111*a*, while a pair of upper shaft holders 307 project from the upper sensor holder 111*b*, and the pivot shaft SA2 are passed through holes 306*a* and 307*a* formed in the lower and upper shaft holders 306, 307, respectively, whereby the upper sensor holder 111*b* is mounted to the lower sensor holder 111*a* pivotably. In one example, the pivot shaft SA2 is fitted and fixed into the through holes 307*a* of the upper shaft holders 307 and extends through the through holes 306*a* of the lower shaft holders 306 pivotably. In another example, the pivot shaft SA2 is fitted and fixed into the through holes 306*a* of the lower shaft holders 306 and extends through the through holes 307*a* of the upper shaft holders 307 pivotably.

Figure 17:
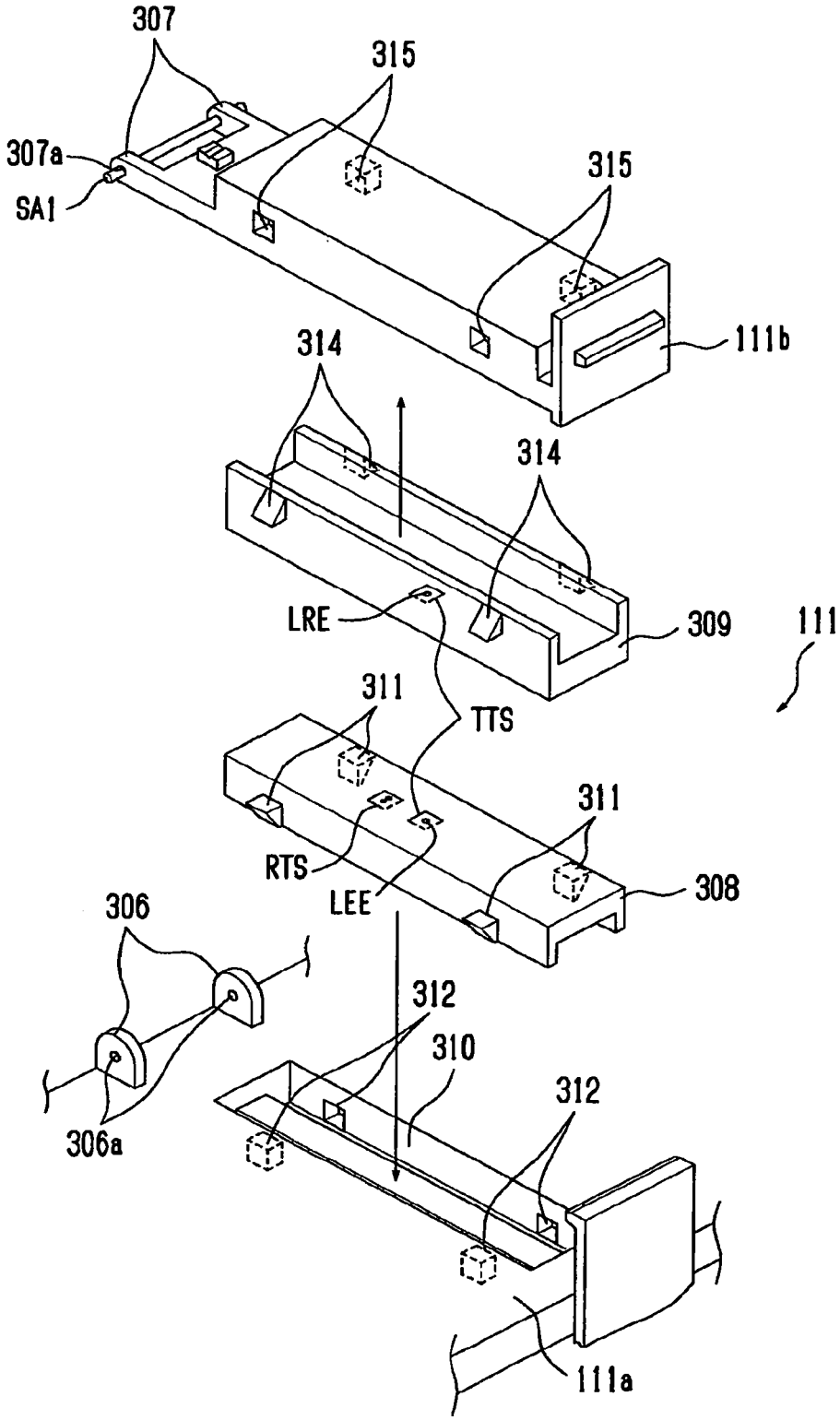
FIG. 17 is an exploded perspective view of the sensor unit.

FIG. 17 is an exploded perspective view of the sensor unit 111. In the sensor unit 111 there are provided a transmission type sensor TTS and a reflection type sensor RTS. A light emitting element LEE in the transmission type sensor TTS, as well as the reflection type sensor RTS, are provided in the lower sensor holder 111*a*. The light emitting element LEE in the transmission type sensor TTS, as well as the reflection type sensor RTS are attached to a lower sensor frame 308 which can be attached to and detached from the body of the lower sensor holder 111*a*. The lower sensor frame 308 constitutes a part of the lower sensor holder 111*a*. A light receiving element LRE of the transmission type sensor TTS is provided in the upper sensor holder 111*b*. The light receiving element LRE of the transmission type sensor TTS is attached to an upper sensor frame 309 which can be attached to and detached from the body of the upper sensor holder 111*b*. The upper sensor frame 309 constitutes a part of the upper sensor holder 111*b*. The structure for mounting and dismounting the lower sensor frame 308 relative to the body of the lower sensor holder 111*a* and the structure for mounting and dismounting the upper sensor frame 309 relative to the body of the upper sensor holder 111*b* are both retaining structures. More specifically, a recess 310 is formed in the body of the lower sensor holder 111*a*, and the lower sensor frame 308 is fitted in the recess 310. Lower retaining pawls 311 are formed on the lower sensor frame 308 so as to be engageable with and disengageable from lower retaining portions 312 formed in the recess 310. Therefore, the lower sensor frame 308 can be easily mounted to and dismounted from the body of the lower sensor holder 111*a* (see FIGS. 19(A) and 19(B)). A recess 313 is formed also in the body of the upper sensor holder 111*b* (see FIGS. 18(A) and 18(B)), and the upper sensor frame 309 is fitted in the recess 313. Upper retaining pawls 314 are formed on the upper sensor frame 309 so as to be engageable with and disengageable from upper retaining portions 315 formed in the upper sensor holder 111*b*. Therefore, the upper sensor frame 309 can be mounted to and dismounted from the body of the upper sensor holder 111*b* (see FIGS. 20(A) and 20(B)).

The light emitting element LEE of the transmission type sensor TTS and the reflection type sensor RTS, in a mounted state on a wiring substrate, are attached to the lower sensor frame 308. The light receiving element LRE of the transmission type sensor TTS, in a mounted state on a wiring substrate, is attached to the upper sensor frame 309. The wiring substrate is slidable in the longitudinal direction of the lower and upper sensor frames 308, 309.

Figure 18A:
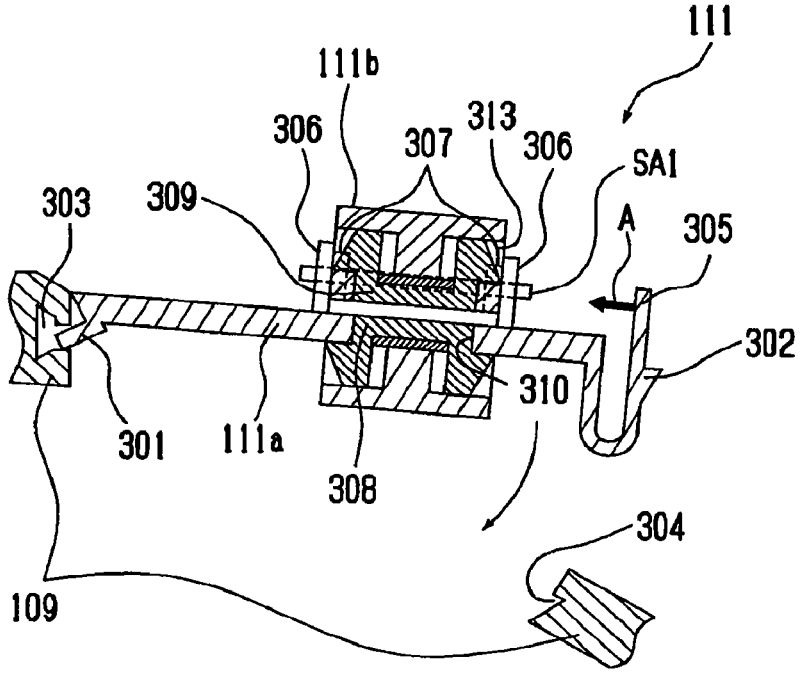
FIG. 18(A) is a side view with the sensor unit not mounted, for explaining an operation for mounting the sensor unit to the lower base unit.

FIG. 18(A) is a diagram for explaining the operation for mounting and dismounting the sensor unit 111 to and from the lower base unit 109. It is a side view showing a state in which the sensor unit 111 is not mounted. To mount the sensor unit 111 to the lower base unit 109, the front retaining pawls 301 are fitted in the retaining portions 303 of the lower base unit 109, as shown in FIG. 18(A). Then, with these retained portions as a fulcrum, the rear portion of the sensor unit 111 is moved downward so that the retaining pawls 302 are engaged with the retaining portions 304. At this time, the U-bent portions 305 having elasticity are deflected in the direction of arrow A shown in FIG. 18(A) to create a state in which the retaining pawls 302 formed on the U-bent portions 305 can be engaged with the retaining portions 304.

Figure 18B:
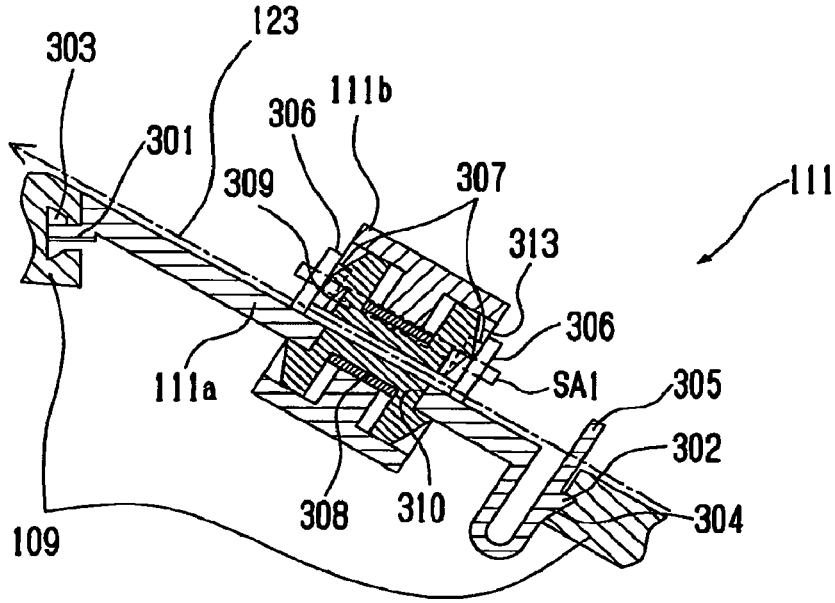
FIG. 18(B) is a side view with the sensor unit mounted, for explaining an operation for dismounting the sensor unit from the lower base unit.

FIG. 18(B) is a diagram for explaining the operation for mounting and dismounting the sensor unit 111 to and from the lower base unit 109. It is a side view showing a mounted state of the sensor unit 111. When the U-bent portion 305 reverts to its original shape from its deflected state, in which it is deflected in the arrow A direction, the retaining pawls 302 are retained by the retaining portions 304, as shown in FIG. 18(B). As a result, the sensor unit 111 is mounted to the lower base unit 109. At this time, the paper conveyance path 123 is formed between the lower sensor holder 111*a* and the upper sensor holder 111*b*.

To remove the sensor unit 111 from the lower base unit 109, the U-bent portions 305 are deflected to disengage the retaining pawls 302 from the retaining portions 304 and then the rear portion of the sensor unit 111 is lifted upward, whereby the rear portion of the sensor unit 111 becomes free with the engaged portions of the retaining pawls 301 with the retaining portions 303 as a fulcrum, as shown in FIG. 18(A). Thus, by disengaging the retaining pawls 301 from the retaining portions 303 it is possible to remove the sensor unit 111 from the lower base unit 109.

Therefore, the mounting and dismounting of the sensor unit 111 relative to the printer 101 can be done easily without using such fixing members as screws or such a tool as a screwdriver.

Figure 19A:
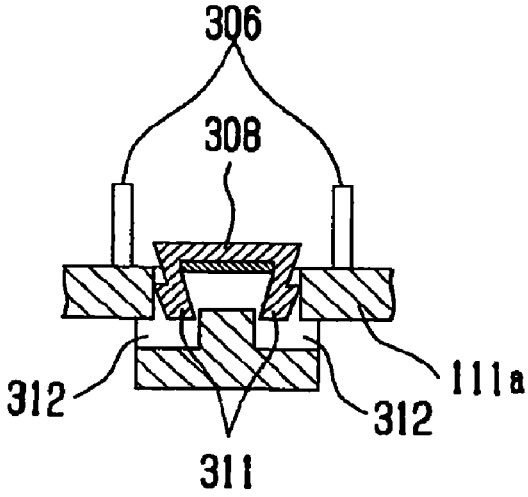
FIG. 19(A) is a side view with a lower sensor frame not mounted, for explaining an operation for mounting a lower sensor frame to a body of the lower sensor holder.

FIG. 19(A) is a diagram for explaining the operation for mounting and dismounting the lower sensor frame 308 to and from the lower sensor holder 111*a*. It is a side view showing a state in which the lower sensor frame 308 is not mounted. To mount the lower sensor frame 308 to the body of the lower sensor frame 111*a*, the lower sensor frame 308 is moved down so that the lower retaining pawls 311 come into abutment against the lower sensor holder 111*a*. Then, as shown in FIG. 19(A), the lower retaining pawls 311 are pressed and bent by the abutted portions thereof against the lower sensor holder 111*a*.

Figure 19B:
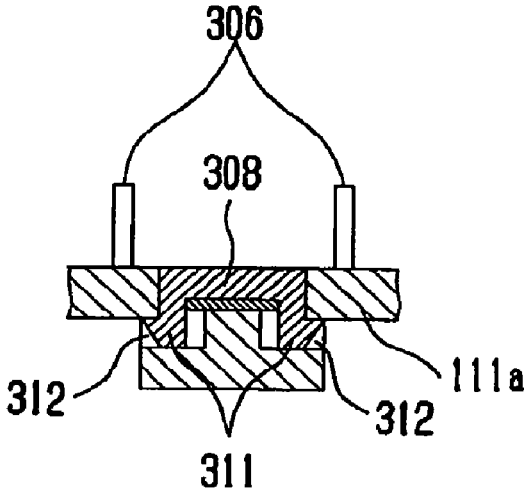
FIG. 19(B) is a side view with the lower sensor frame mounted, for explaining an operation for dismounting the lower sensor frame from the body of the lower sensor holder.

FIG. 19(B) is a diagram for explaining the operation for mounting and dismounting the lower sensor frame 308 to and from the body of the lower sensor holder 111*a*. It is a side view showing a mounted state of the lower sensor frame 308. As the lower sensor frame 308 is further moved down, the bent lower retaining pawls 311 are fitted in and retained by the lower retaining portions 312 with a restoring force induced by the elasticity of the lower sensor frame, as shown in FIG. 19(B), whereby the lower sensor frame 308 is held by the lower sensor holder 111*a*.

To remove the lower sensor frame 308 from the lower sensor holder 111*a*, the lower retaining pawls 311 are pushed and bent from holes of the lower retaining portions 312 so as to disengage the lower retaining pawls 311 from the lower retaining portions 312. Upon bending and disengagement of the lower retaining pawls 311, the lower retaining pawls 311 are pushed up from the holes of the lower retaining portions 312, causing the lower sensor frame 308 to rise. As a result, the lower retaining pawls 311 are pushed into a bent state by the lower sensor holder 111*a*, as shown in FIG. 19(A). Therefore, by lifting the lower sensor frame 308, the lower sensor frame 308 can be removed from the lower sensor holder 111*a*.

Figure 20A:
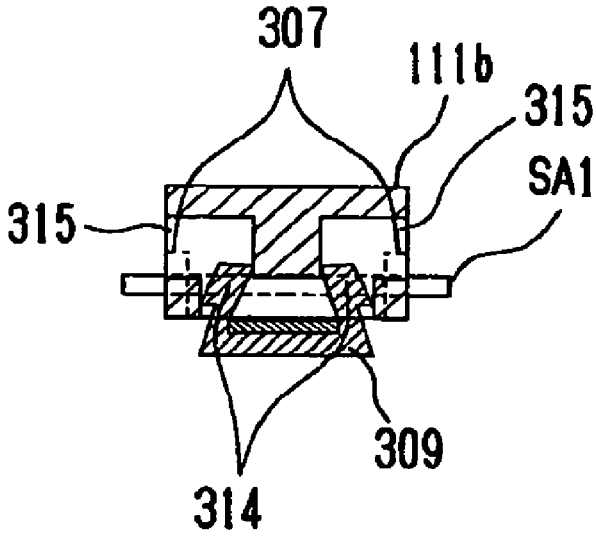
FIG. 20(A) is a side view with an upper sensor frame not mounted, for explaining an operation for mounting an upper sensor frame to a body of the upper sensor holder.

FIG. 20(A) is a diagram for explaining the operation for mounting and dismounting the upper sensor frame 309 to and from the body of the upper sensor holder 111*b*. It is a side view showing a state in which the upper sensor frame 309 is not mounted. To mount the upper sensor frame 309 to the upper sensor holder 111*b*, as shown in FIG. 20(A), the upper retaining pawls 314 are brought into a bent state by abutment thereof against the upper sensor holder 111*b* and are then pushed so that the upper sensor frame 309 is fitted in the recess 313 of the upper sensor holder 111*b*.

Figure 20B:
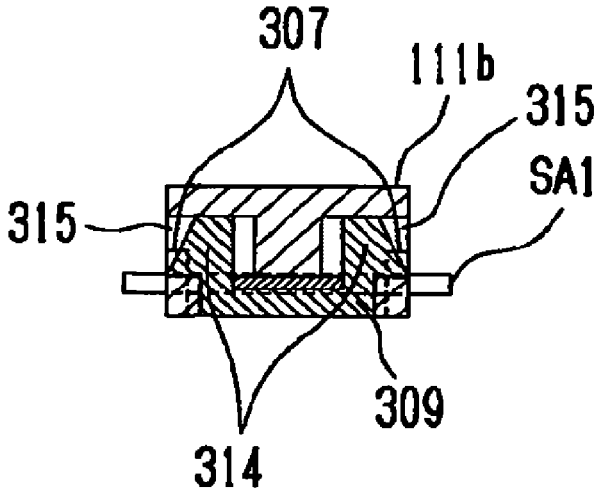
FIG. 20(B) is a side view with the upper sensor frame mounted, for explaining an operation for dismounting the upper sensor frame from the body of the upper sensor holder.

FIG. 20(B) is a diagram for explaining the operation for mounting and dismounting the upper sensor frame 309 to and from the body of the upper sensor holder 111*b*. It is a side view showing a mounted state of the upper sensor frame 309. As shown in FIG. 20(B), the bent retaining pawls 314 revert to the original state and are retained by the retaining portions 315, so that the upper sensor frame 309 is held by the upper sensor holder 111*b*.

To remove the upper sensor frame 309 from the state shown in FIG. 20(B), the upper retaining pawls 314 are disengaged into the state shown in FIG. 20(A), and then the upper sensor frame 309 is removed from the recess 313 of the upper sensor holder 111*b*, whereby the upper sensor frame 309 can be removed from the upper sensor holder 111*b*.

According to this embodiment, since the sensor unit 111 can be mounted to and removed from the printer 101 without using such a tool as a screwdriver, even in the event of failure of the sensor unit 111, the sensor unit 111 can be replaced in a simple manner. The lower sensor frame 308 and the upper sensor frame 309 can also be mounted to and removed from the sensor unit 111 and therefore it is possible to effect replacement of only a specific sensor portion, whereby the workability of the sensor unit 111 and printer 101 can be further improved.

Although in this embodiment the light emitting element LEE and the light receiving element LRE in the transmission type sensor TTS are attached to the lower sensor frame 308 and the upper sensor frame 309, respectively, the light receiving element LRE may be attached to the lower sensor frame 308 and the light emitting element LEE may be attached to the upper sensor frame 309. Further, the reflection type sensor RTS may be attached to the upper sensor frame 309.

Obviously, numerous modifications and variations of the present invention are possible in light of the above teachings. It is therefore to be understood that within the scope of the appended claims, the invention may be practiced otherwise than as specifically described herein.

What is claimed is:

1. A printer, comprising:

a first unit including a paper holder;

a second unit adapted to open and close pivotably relative to the first unit;

a paper path which extends from the paper holder to an exterior;

a printing section configured to execute a print operation on paper conveyed from the paper holder along the paper path;

a sensor unit which: (i) comprises a lower sensor holder and an upper sensor holder pivotably engaged with the lower sensor holder, one of the lower sensor holder and the upper sensor holder including both a light emitting element configured to emit light to the paper and a light receiving element configured to detect light reflected by the paper in response to the light emitted by the light emitting element, and (ii) is attached to the first unit so that the paper passes between the lower sensor holder and the upper sensor holder; and a damper mechanism attached to the sensor unit and disposed between the sensor unit and the paper holder, the damper mechanism having a paper abutment portion and a spring, the spring pressing the paper abutment portion against the paper conveyed along the paper path and applying tension to the paper.

2. The printer according to claim 1, wherein the paper abutment portion extends on a plane of the paper path and in a direction orthogonal to an advancing direction of the paper.

3. The printer according to claim 1, wherein other one of the lower sensor holder and the upper sensor holder includes at least one of a light emitting element and a light receiving element.

4. The printer according to claim 3, wherein the paper abutment portion includes a roller that is configured to be pressed against and apply tension to the paper, the roller being rotated when the paper is conveyed along the paper path.

5. The printer according to claim 1, wherein the spring has a fixed portion and a movable portion that rotates the paper abutment portion about the fixed portion.

6. The printer according to claim 1, wherein the paper abutment portion is pressed against the paper conveyed along the paper path in a direction substantially perpendicular to a plane of the paper path.

7. A printer, comprising:

a first unit including a paper roll;

a second unit adapted to open and close pivotably relative to the first unit;

a paper path which is formed between the first unit and the second unit and extends from the paper roll to an exterior;

a printing section configured to execute a print operation on paper, which is conveyed from the paper roll along the paper path, at a first portion of the paper path;

a sensor unit which: (i) comprises a lower sensor holder and an upper sensor holder pivotably engaged with the lower sensor holder, one of the lower sensor holder and the upper sensor holder including both a light emitting element configured to emit light to the paper and a light receiving element configured to detect light reflected by the paper in response to the light emitted by the light emitting element, and (ii) is attached to the first unit so that the paper passes between the lower sensor holder and the upper sensor holder; and a damper mechanism attached to the sensor unit, the damper mechanism having a paper abutment portion and a spring, the spring pressing the paper abutment portion against the paper at a second portion of the paper path between the sensor unit and the paper roll.

8. The printer according to claim 7, wherein the paper abutment portion extends on a plane of the paper path and in a direction orthogonal to an advancing direction of the paper.

9. The printer according to claim 8, wherein the paper abutment portion includes a roller that is configured to be pressed against and apply tension to the paper at the second portion of the paper path, the roller being rotated when the paper at the second portion of the paper path is conveyed along the paper path.

10. The printer according to claim 7, wherein the spring has a fixed portion and a movable portion that rotates the paper abutment portion about the fixed portion.

11. The printer according to claim 7, wherein the paper abutment portion is disposed between the paper path and the second unit.

12. The printer according to claim 11, wherein the paper abutment portion is disposed at different positions between the paper path and the second unit depending on a diameter of the paper roll.

13. The printer according to claim 11, wherein the paper abutment portion is disposed at different positions between the paper path and the second unit depending on whether the paper roll is inwards-wound or outwards-wound.

14. The printer according to claim 7, wherein a degree of bending of the paper at the second portion of the paper path varies in accordance with a diameter of the paper roll.

15. The printer according to claim 7, wherein a degree of bending of the paper at the second portion of the paper path varies in accordance with whether the paper roll is inwards-wound or outwards-wound.

16. The printer according to claim 7, wherein other one of the lower sensor holder and the upper sensor holder includes at least one of a light emitting element and a light receiving element.

17. A printer, comprising:

a first unit including a paper holder;

a second unit adapted to open and close pivotably relative to the first unit;

a paper path which is formed between the first unit and the second unit and extends from the paper holder to an exterior;

a printing section configured to execute a print operation on paper conveyed from the paper holder along the paper path;

a sensor unit which: (i) comprises a lower sensor holder and an upper sensor holder pivotably engaged with the lower sensor holder, one of the lower sensor holder and the upper sensor holder including both a light emitting element configured to emit light to the paper and a light receiving element configured to detect light reflected by the paper in response to the light emitted by the light emitting element, and (ii) is attached to the first unit so that the paper passes between the lower sensor holder and the upper sensor holder; and a damper mechanism attached to the sensor unit and disposed between the sensor unit and the paper holder, the damper mechanism having a paper abutment portion and a spring, the spring pressing the paper abutment portion toward the paper conveyed along the paper path.

18. The printer according to claim 17, wherein the paper abutment portion is disposed between the paper path and the second unit.

19. The printer according to claim 17, wherein the paper abutment portion extends on a plane of the paper path and in a direction orthogonal to an advancing direction of the paper.

20. The printer according to claim 19, wherein the paper abutment portion has a curved surface that is configured to be pressed against and apply tension to the paper.

21. The printer according to claim 19, wherein the paper abutment portion includes a roller that is configured to be pressed against and apply tension to the paper, the roller being rotated when the paper is conveyed along the paper path.

22. The printer according to claim 17, wherein the spring has a fixed portion and a movable portion that rotates the paper abutment portion about the fixed portion.

23. The printer according to claim 17, wherein other one of the lower sensor holder and the upper sensor holder includes at least one of a light emitting element and a light receiving element.

* * * * *